US010317159B2

(12) United States Patent
Zajk

(10) Patent No.: US 10,317,159 B2
(45) Date of Patent: Jun. 11, 2019

(54) VARIABLE BARREL CAMMING SYSTEM FOR FIREARM

(71) Applicant: Sturm, Ruger & Company, Inc., Southport, CT (US)

(72) Inventor: Joseph J. Zajk, Prescott, AZ (US)

(73) Assignee: Sturm, Ruger & Company, Inc.

( * ) Notice: Subject to any disclaimer, the term of this patent is extended or adjusted under 35 U.S.C. 154(b) by 223 days.

(21) Appl. No.: 15/388,996

(22) Filed: Dec. 22, 2016

(65) Prior Publication Data

US 2017/0184358 A1 Jun. 29, 2017

Related U.S. Application Data

(60) Provisional application No. 62/271,472, filed on Dec. 28, 2015.

(51) Int. Cl.
*F41A 19/32* (2006.01)
*F41A 17/56* (2006.01)
(Continued)

(52) U.S. Cl.
CPC ..... *F41A 19/32* (2013.01); *F41A 5/04* (2013.01); *F41A 5/06* (2013.01); *F41A 17/56* (2013.01); *F41A 19/10* (2013.01); *F41A 19/12* (2013.01); *F41A 19/15* (2013.01); *F41A 19/30* (2013.01); *F41A 21/00* (2013.01); *F41C 3/00* (2013.01)

(58) Field of Classification Search
CPC ..... F41C 23/06; F41C 3/00; F41A 21/484; F41A 21/00; F41A 19/32; F41A 19/12; F41A 5/04; F41A 5/06
See application file for complete search history.

(56) References Cited

U.S. PATENT DOCUMENTS 1,618,510 A 2/1927 Browning
2,664,786 A * 1/1954 Guisasola ..... F41A 5/04 42/7

(Continued)

FOREIGN PATENT DOCUMENTS

CH 270873 A * 9/1950 ..... F41A 5/04

OTHER PUBLICATIONS

Corresponding International Search Report and Written Opinion for PCT/US16/68372 dated Sep. 13, 2017.

*Primary Examiner* — Benjamin P Lee
(74) *Attorney, Agent, or Firm* — The Belles Group, P.C.

(57) ABSTRACT

A variable barrel camming system for a firearm includes a linearly reciprocating slide supported by a frame and a barrel removably coupled to the slide for movement therewith. A cam slot on the barrel slideably engages a cam pin mounted transversely in the frame. The slot includes a cam track surface having multiple angles and contours designed to control the motion and orientation of the barrel. When the firearm is discharged, the slide and barrel initially move rearward together under recoil forces generated. The pin slides forward in the slot over the cam track surface which is configured to rotate and uncouple the barrel from the slide which continues rearward alone. The cam track surface has a varying cam profile selected to gradually dissipate the kinetic energy of the barrel/slide unit in a controlled manner, thereby reducing the felt recoil imparted to a user compared to conventional cam systems.

24 Claims, 21 Drawing Sheets

(51) Int. Cl.

| | |
|---|---|
| ***F41A 19/10*** | (2006.01) |
| ***F41A 19/12*** | (2006.01) |
| ***F41A 19/15*** | (2006.01) |
| ***F41A 19/30*** | (2006.01) |
| ***F41A 5/04*** | (2006.01) |
| ***F41A 5/06*** | (2006.01) |
| ***F41A 21/00*** | (2006.01) |
| ***F41C 3/00*** | (2006.01) |

(56) References Cited

U.S. PATENT DOCUMENTS

| | | | | |
|---|---|---|---|---|
| 5,581,046 | A * | 12/1996 | Weldle | F41A 3/86 89/163 |
| 5,734,120 | A | 3/1998 | Besselink | |
| 2005/0229772 | A1 * | 10/2005 | Mayerl | F41A 5/04 89/167 |
| 2010/0005956 | A1 | 1/2010 | Wossner | |
| 2011/0289811 | A1 | 12/2011 | Gentilini et al. | |
| 2015/0292828 | A1 | 10/2015 | Nebeker et al. | |
| 2017/0184358 | A1 | 6/2017 | Zajk | |

* cited by examiner

VARIABLE BARREL CAMMING SYSTEM FOR FIREARM

CROSS-REFERENCE TO RELATED APPLICATIONS

The present application claims the benefit of priority to U.S. Provisional Application No. 62/271,472, filed Dec. 28, 2015, which is incorporated herein by reference in its entirety.

BACKGROUND

The present invention generally relates to firearms, and more particularly to systems used for camming the barrel under recoil after discharging the firearm and related methods for the same.

Firearms such as semiautomatic auto-loading pistols come in a variety of full size and compact platforms. Auto-loading pistols generally include a frame, an axially reciprocating slide mounted on the frame, and a barrel carried by the slide. One type of firing mechanism found in such pistols utilizes a pivotable spring-biased pivotable hammer which is held in a rear cocked and ready-to-fire position. To discharge the pistol, the hammer is released from a cocked position via a trigger pull which in turn impacts and drives a firing pin forward to contact and detonate a chambered ammunition cartridge. Alternatively, "striker-fired" pistols have a firing mechanism which utilize a linearly movable spring-biased striker that is held in a cocked position. Pulling the trigger releases the striker to directly contact and detonate a chambered ammunition round without the intervening firing pin.

In John M. Browning's early patent describing the mechanism of the Browning Hi-Power pistol (U.S. Pat. No. 1,618,510), he teaches a method of controlling the recoiling components of an autoloading pistol by means of a tilting barrel that uses a strictly linear cam surface on the barrel that engages a transverse pin (or surface of a cam block) that is attached to the frame. During the firing sequence of the pistol, the slide and barrel travel together during recoil in opposite reaction to the forward motion of the bullet and pressure generated by the deflagrating propellant. After the barrel and slide travel together for a short distance, the linear cam surface on the barrel engages the pin or surface of the cam block, and the barrel is pulled down and out of engagement with the slide. The barrel then stops and the slide continues to the rear, thereby allowing the empty cartridge case to be extracted from the now stationary barrel. As the slide continues its rearward travel, the pressure due to firing drops to zero (hence the force pushing the slide drops to zero) and the recoil spring compresses and begins to slow the slide. The cartridge case is ejected, and then the slide finally stops on the frame at its full rearward travel. The slide then returns forward due to the force of the recoil spring which is now returning to its original extended condition. In the process the slide strips a new round of ammunition out of the magazine, pushes it into the chamber of the barrel, pushes the barrel back up the linear cam and into its locked position with the slide, and then the slide/barrel group move the final distance forward into the firing position.

This linear cam system, invented in 1923, is used today in basically its original form as described by John Browning, and is the most popular short-recoil system in use for autoloading pistols. However, as ammunition performance has improved over the years, primarily in the development of large caliber, higher velocity cartridges that generate higher pressures, the original linear cam system described by Browning is proving to be insufficient as a means of controlling the velocity of the slide and hence the recoil force transmitted to both the pistol and the user.

An improved method of controlling slide velocity is needed that controls the velocity of the slide effectively while maintaining simplicity in design.

SUMMARY

Embodiments of the present invention provide a variable barrel camming system configured for use with firearms chambered for modern larger caliber and higher velocity ammunition cartridges. The barrel includes a cam track surface having a varying cam profile specifically selected to gradually dissipate the kinetic energy of the slide under recoil after discharging the firearm in a controlled manner that reduces the recoil forces imparted to the frame of the firearm and felt recoil experienced by the user.

According to one aspect, a firearm with variable barrel camming system includes: a longitudinal axis; a frame; a slide movably supported on the frame for rearward and forward reciprocating movement; a barrel removably coupled to the slide and movable therewith, the barrel comprising a front muzzle end, a rear breech end defining a chamber for holding an ammunition cartridge, and axial bore extending between the ends; a camming lug protruding downward from the barrel and including a cam slot defining an upper surface and an opposing lower cam track surface, the cam slot including a rear end and an opposing front end; a cam pin fixedly mounted transversely in the frame, the cam pin arranged to slideably engage the cam track surface when the barrel is carried rearward with the slide under recoil after firing the pistol; the cam track surface comprising an initial cam section disposed adjacent the rear end of the cam slot, a concave intermediate variable cam section adjoining and forward of the initial cam section, and a final cam section adjoining and forward of the intermediate variable cam section, the initial and final cam sections each having a different cam profile than the intermediate variable cam section; wherein the cam pin slideably engages and tracks along the cam track surface after firing the pistol causing the barrel in turn to rotate and uncouple from the slide.

According to another aspect, a barrel with cam slot for a firearm includes: a tubular body defining a longitudinal axis; a muzzle end and a breech end defining a chamber for holding an ammunition cartridge; an axial bore extending between the breech and muzzle ends defining a projectile pathway; a camming lug protruding downward from the breech end of the barrel; and a multi-contoured cam slot formed in the camming lug and configured to slideably engage a cam pin, the cam slot including a rear end, a front end, a rear upper surface extending between rear and front ends, and a front lower cam track surface extending between the rear and front ends opposite the upper surface; the lower cam track surface having an undulating cam profile comprising a first concave surface, a second concave surface located forward of the first concave surface, and a convex protrusion arranged between the first and second concave cam surfaces.

A method for operating a firearm is provided. The method includes: providing a firearm including a longitudinal axis, a frame, a horizontally oriented slide supported by the frame in a sliding manner for rearward and forward reciprocating motion, a horizontally oriented barrel removably coupled to the slide and including a cam slot, and a cam pin fixedly disposed transversely in the frame; discharging the firearm; moving the slide and barrel rearward together in coupled relationship; moving the cam pin forward in the cam slot; slideably engaging the cam pin with an initial cam section of the cam slot; slideably engaging the cam pin with an intermediate variable cam section of the cam slot having an arcuately curved concave cam profile; rotating the barrel about the cam pin and uncoupling the barrel from the slide via engagement with the variable cam section; slideably engaging the cam pin with a final cam section of the cam slot; disengaging the cam pin from the final cam section; slideably engaging the cam pin with a re-direction surface of the cam slot having an arcuately curved concave cam profile, the re-direction surface being disposed on an opposite side of the cam slot from the final cam section; and engaging a closed front end of the cam slot with the cam pin, wherein motion of the barrel is arrested. In one embodiment, the initial and final cam sections each have a linear cam profile defining a flat surface.

BRIEF DESCRIPTION OF THE DRAWINGS

The features of the preferred embodiments will be described with reference to the following drawings where like elements are labeled similarly, and in which.

Figure 1:
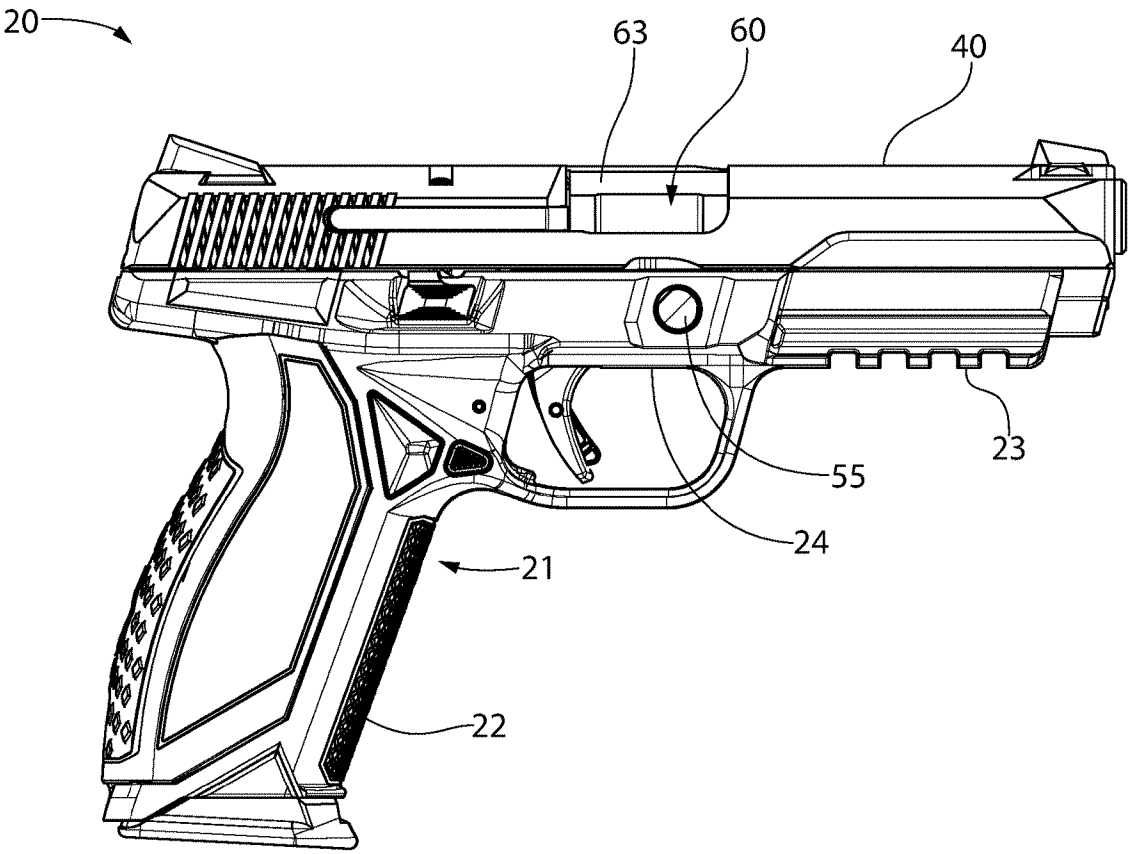
FIG. 1 is a right side elevation view of a firearm in the form of a pistol according to the present disclosure.
Figure 2:
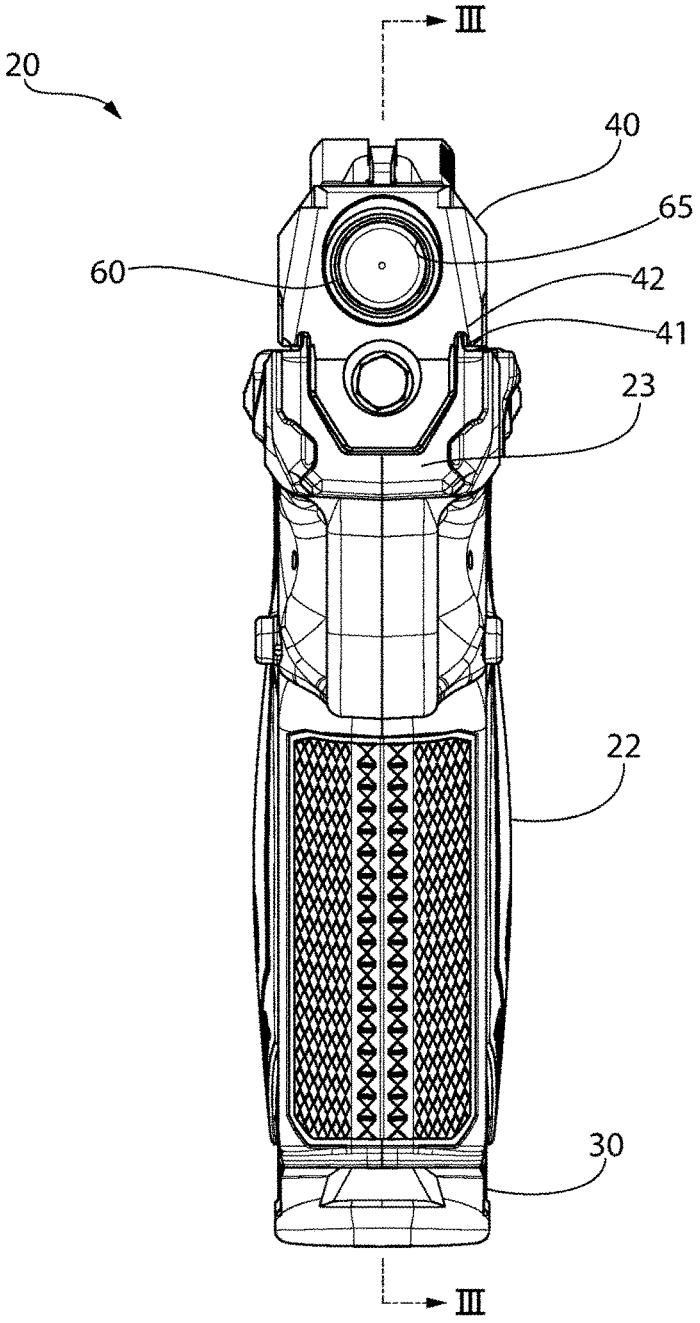
FIG. 2 is a front elevation view thereof.

All drawings are schematic and not necessarily to scale.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

FIGS. 1-16 depict one non-limiting embodiment of a firearm which may be in the form of semiautomatic autoloading pistol 20 having a barrel camming system in accordance with the present disclosure. Pistol 20 defines a longitudinal axis LA and includes a frame 21 having a downwardly extending rear grip portion 22 configured for grasping by a user, a forwardly extending front portion 23, and an intermediate portion 24 therebetween which may include a trigger guard 25. Grip portion 22 defines a downwardly open magazine well 29 configured for mounting a detachable magazine 30 therein. Magazine 30 is a generally hollow structure configured for holding a plurality of ammunition cartridges C which are automatically dispensed and uploaded into the breech area 45 of the pistol by a spring-biased follower 31 each time the action of the firearm is cycled. Magazine spring 32, which applies an upward acting force on the follower 31, may be any suitable type of spring and material.

Pistol 20 further includes an axially slideable and reciprocating slide 40 movably supported by the frame 21 and a barrel 60 carried by the slide and frame 21. Slide 40 may be slideably mounted on pistol 20 via a conventional support rail and groove system for axial reciprocating movement forwards and rearwards thereon when cycling the action manually or under recoil after firing the pistol 20. In one embodiment, the slide 40 may include the laterally spaced apart pair of longitudinally-extending and downwardly open grooves 42 which may be disposed on an underside surface of the slide 40. The grooves 42 are slideably received in a mating pair of laterally spaced apart and upwardly protruding rails 41 formed on the top of the frame 21. Such systems are known and understood by those in the art without further undue elaboration. An axially oriented recoil spring 43 operably associated with slide 40 and mounted in the frame 21 and/or slide acts to bias and return the slide forward to the firing (ready-to-fire) position shown in FIG. 1 after discharging pistol 20. In one embodiment, spring 43 may be mounted in the front portion 23 of the frame 21 below the barrel 60.

Figure 18:
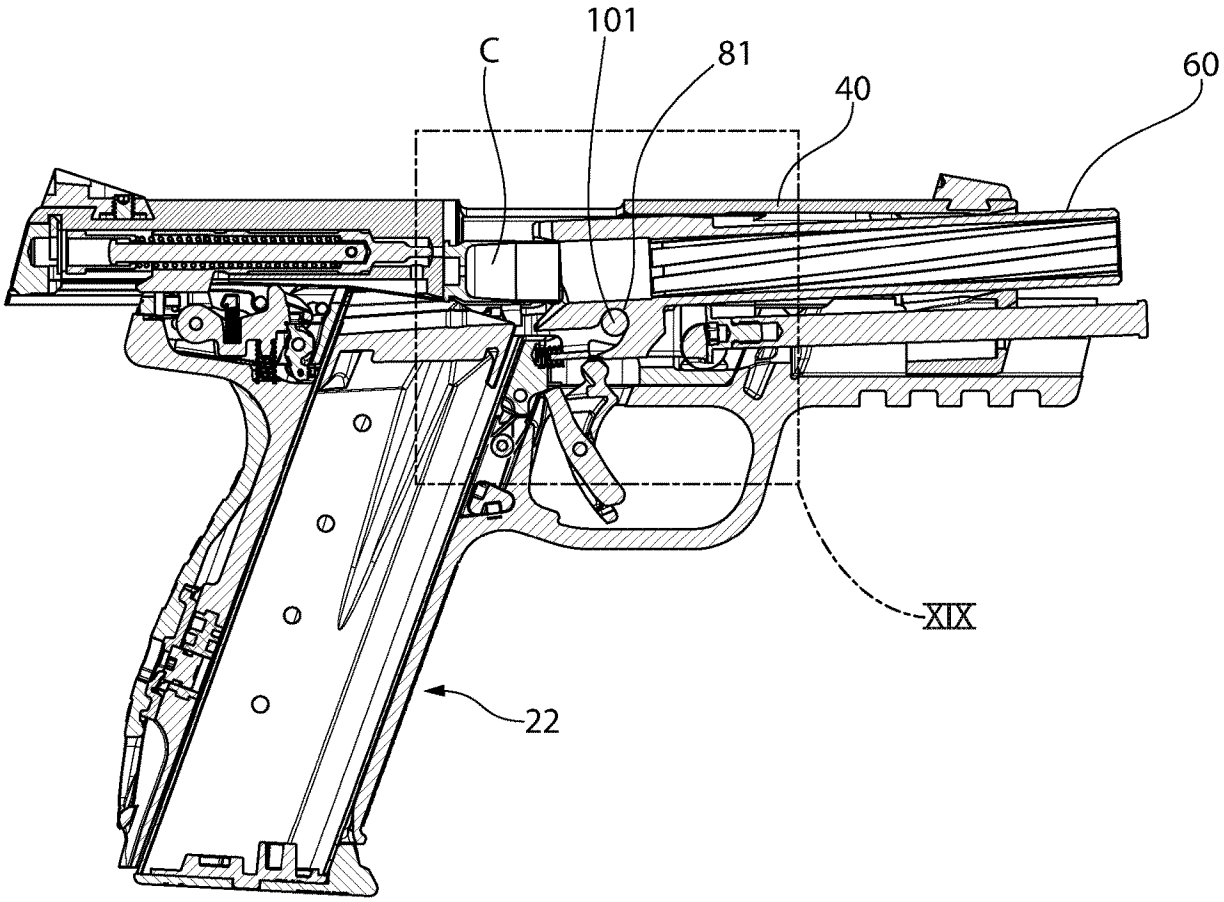
FIG. 18 is a right side cross sectional view of the pistol including a second embodiment of a barrel camming system according to the present disclosure with the action shown in a recoil position in which the barrel motion is fully arrested.

Slide 40 has an axially elongated body and includes a front portion 50, rear portion 51, and a longitudinally-extending cavity 52 formed therebetween and therein for receiving the barrel 60. A downwardly protruding boss 53 engages a front end of the recoil spring assembly which includes spring 43 and recoil spring guide rod 54 over which the spring is positioned. Recoil spring 43 may be a helical compression spring in one embodiment; however, other types of springs may be used. A rear end of spring 43 engages the frame or an intervening member such as cross pin 55 (e.g. takedown pin) attached to the frame (see, e.g. FIGS. 3 and 4). Slide 40 further defines an open ejection port 68 for ejecting a spent cartridge casing and/or inspecting the barrel chamber 64 for the presence of a cartridge when the breech is fully opened as shown in FIG. 18. Ejection port 68 is upwardly and laterally open as shown and may be formed intermediately between ends 50 and 51 of the slide 40.

Figure 3:
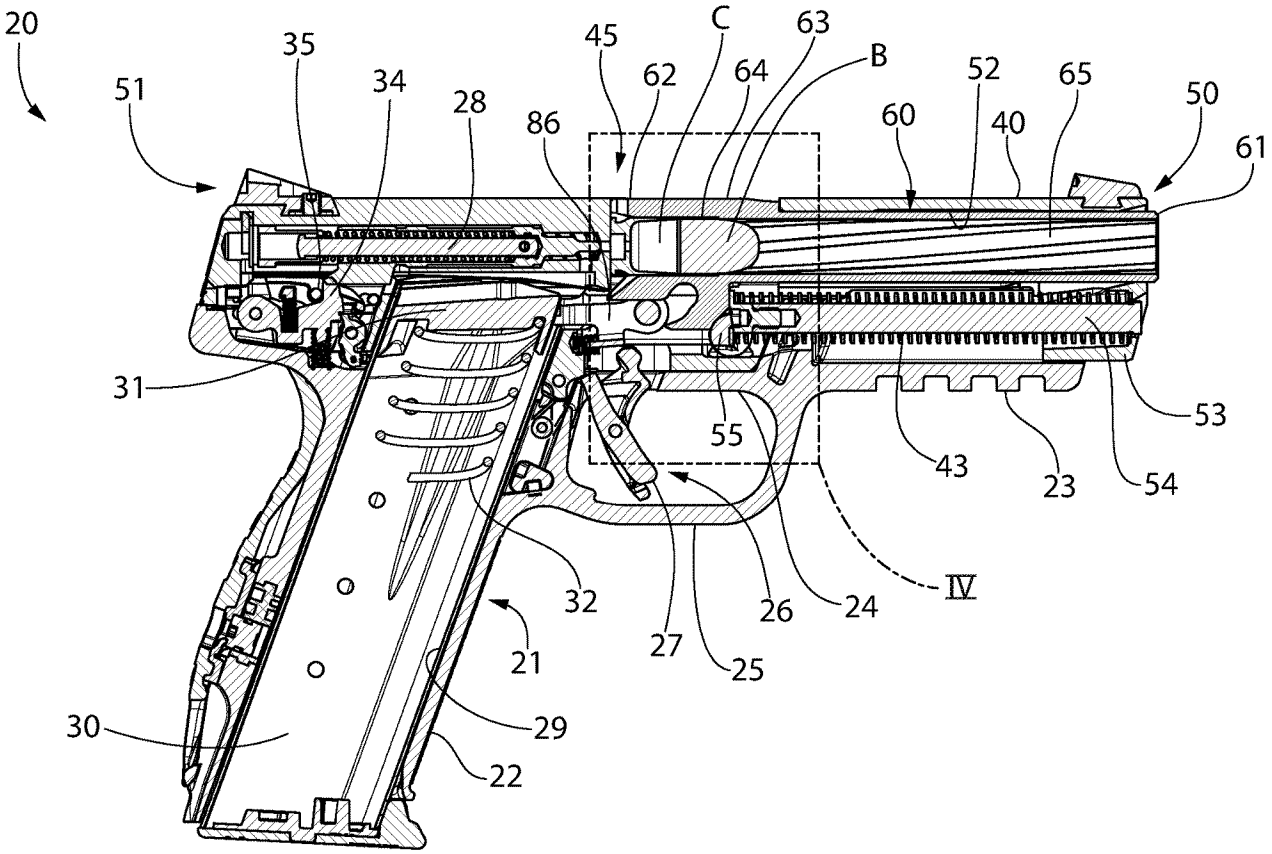
FIG. 3 is a right side cross sectional view of the pistol of FIG. 1 showing the action in the ready-to-fire position.
Figure 4:
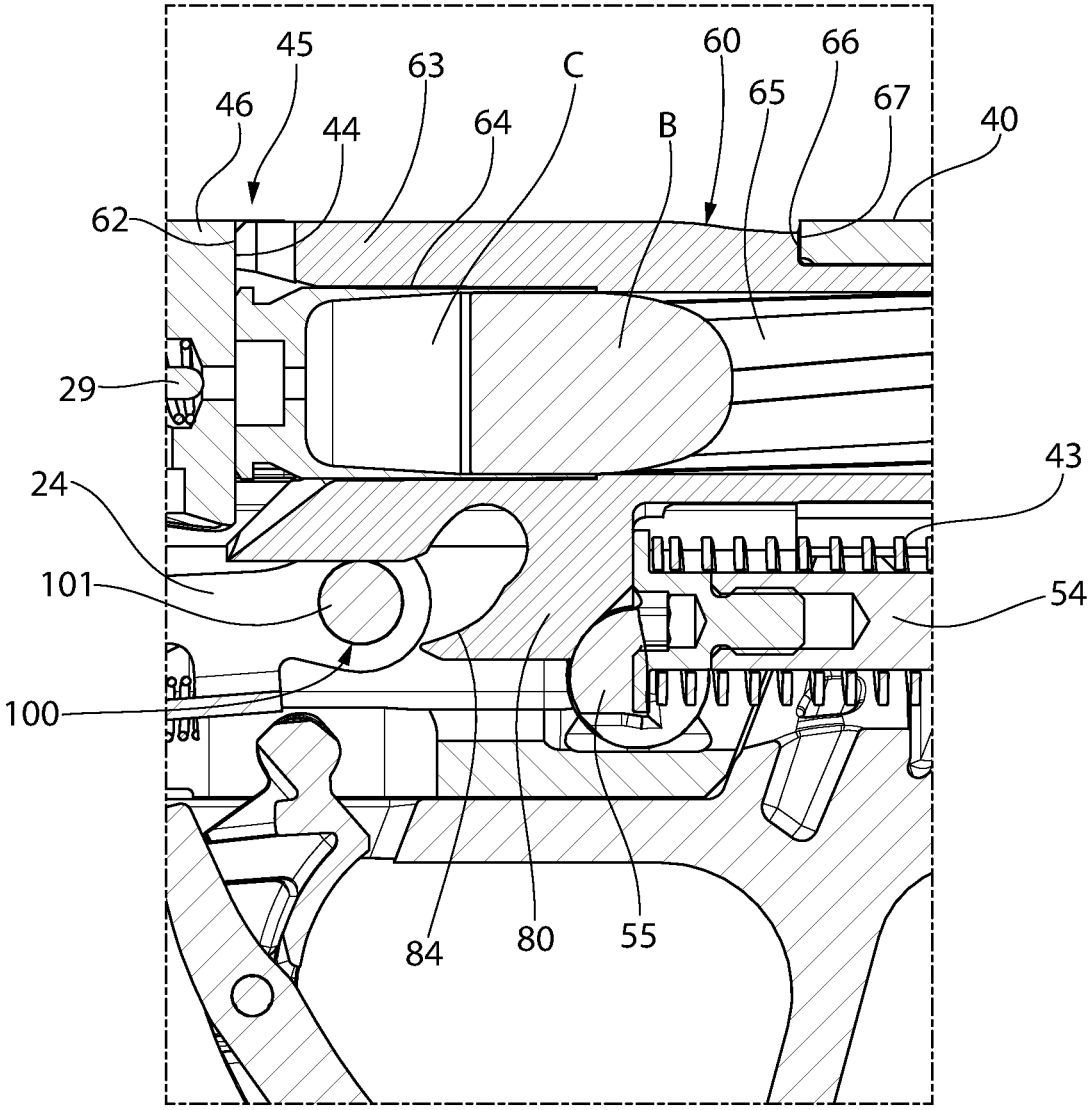
FIG. 4 is an enlarged detail view taken from FIG. 3 showing the variable barrel camming system according to the present disclosure including the cam track or slot and pin.

With continuing reference to FIGS. 1-18, barrel 60 is movably disposed at least partially inside slide 40 collectively forming a barrel-slide assembly which moves in response to discharging the pistol or manually cycling the action. Barrel 60 has an axially elongated and generally tubular body. Barrel 60 includes a front muzzle end 61 from which a projectile exits the barrel and a rear breech end 62 defining an enlarged chamber block 63 having a rearwardly open chamber 64 configured for holding a cartridge C. Chamber block 63 may have a generally polygonal configuration such as rectangular in contrast to portions of the barrel forward of the chamber block which is generally cylindrical in shape as illustrated. Chamber block 63 may be at least partially exposed and visible through the open ejection port 68 formed in the slide 40 as shown in FIGS. 3 and 4 when the slide is in battery with the barrel. A longitudinally extending bore 65 is defined between muzzle and breech ends 61, 62 which forms a pathway for the projectile such as a slug or bullet B. Bore 65 is coaxially aligned with longitudinal axis LA when the pistol is in the ready-to-fire position (see, e.g. FIGS. 3 and 4) and orientation of the barrel is horizontal. Bore 65 may be rifled in some embodiments as shown. Breech end 62 of barrel 60 may further include a rearwardly extending angled cartridge feed ramp 70 to facilitate loading cartridges C from magazine 30 into chamber 64 (best shown in FIG. 5). Ramp 70 is positioned below chamber 64.

An openable and closeable breech area 45 (or simply "breech") is defined at the rear breech end 62 of barrel 60 approximately above the magazine well 29 of the frame 21. The slide 40 includes a breech block 46 that defines a forward facing breech face 44 which creates a closed breech (see, e.g. FIG. 4) when in battery with the rear breech end 62 of the barrel 60 for firing the pistol 20 or an open breech (see, e.g. FIG. 15) for extracting/ejecting spent cartridge casings and loading fresh cartridges C into the chamber 64. The barrel 60 may preferably be made of steel in one embodiment for strength and durability to withstand the high pressures developed by igniting a cartridge charge and increase the longevity of the barrel bore 65 which encounters the bullet or slug. Slide 40 may preferably be made of any suitable metal, and more preferably a light-weight metal such as aluminum or titanium in some embodiments for weight reduction. Other suitable materials may be used for the barrel and slide, and is not limiting of the invention.

A trigger-actuated firing mechanism 26 operates to discharge pistol 20. The firing mechanism may generally comprise a movable trigger 27 slideably or pivotably mounted to frame 21 and operably connected via a mechanical linkage 34 to an axially movable spring-biased striker 28 disposed in the slide 30. The axially elongated and generally cylindrical striker is configured and arranged to move linearly forward to strike a chambered cartridge C. Striker 28 has a diametrically narrowed front tip 29 which is projectable beyond the breech face 44 of the slide 40 to in turn strike and detonate a chambered cartridge C. The firing mechanism 26 is configured to hold the striker 28 in a rearward cocked and ready-to-fire position until the trigger is pulled which releases the striker. In one embodiment, the firing mechanism may include a sear 34 operably linked between the trigger 36 and striker 28 via a trigger bar 86. The trigger bar is movable in rearward and forward axial directions via operation of the trigger. Sear 34 operates to alternatingly hold or release the striker from the cocked position when the trigger is pulled. The sear 34 may have an upwardly extending protrusion which releasably engages a downwardly projecting striker catch protrusion 35 on the bottom of the striker 28 for maintaining the cocked position or releasing the striker. Pulling trigger 27 with a closed breech rotates the sear and releases the cocked striker 28 in a forward linear path to strike the chambered cartridge and discharge the pistol.

In alternative embodiments contemplated, a conventional hammer-fired firing mechanism which includes a cockable and pivotable hammer mounted to the frame may instead be provided which is operably linked to the firing mechanism. In such firing systems which are well known in the art, the firing mechanism releases the spring-biased cocked hammer which in turn strikes a spring-biased firing pin in the slide to drive it forward for striking the cartridge. Such hammer-type firing systems are shown for example in commonly owned U.S. patent application Ser. No. 15/155,601, which is incorporated herein by reference in its entirety. Either type firing mechanism may be used with equal benefit derived from the present barrel camming system and is not limiting of the invention.

When the barrel 60 and slide 40 are operably coupled together in one operational phase of discharging pistol 20, the barrel is moveable rearwards with the slide 40 in unison under recoil after discharging pistol 20 or when manually cycling the action for at least part of the rearward travel of slide 40 on frame 21. In a subsequent operation phase, the barrel 60 and slide 40 are operably uncoupled so that the barrel motion is arrested while the slide continues to travel rearward. To achieve these dual operational roles, a coupling mechanism is which operates to alternatingly lock or unlock the barrel 60 from the slide 40. In one embodiment, the coupling mechanism comprises a rear facing locking surface 66 formed on the slide 40 which abuttingly engages a mating front facing locking surface 67 on the barrel. In one embodiment, locking surface 67 may be formed on the front top of chamber block 63 and locking surface 66 may be formed at the front of open ejection port 68 on the slide 40. Other arrangements and configurations are possible. Locking surfaces 66, 67 may be oriented perpendicular to the longitudinal axis LA of pistol 20 in one embodiment; however, other angles could be used to provide the mating locking or abutment surfaces.

Operating Principle

The operation of any autoloading pistol is derived directly from the conversion of the potential energy stored in the propellant powder to kinetic energy (heat and pressure) via the deflagration (hi-speed burning) of the propellant. Of these, the pressure generated is the energy that can be readily converted into useful work. In the Browning type tilting-barrel system, there are several distinct phases of the recoil portion of the pistol operation as follows with reference to the graph of FIG. 17.

Phase 1: Slide and Barrel Travel Together

In the first phase, the barrel and slide begin to travel to the rear as a group due to the reaction to the pressure of the propellant gasses pushing the bullet forward out the barrel until the bullet exits, and then the reaction to the decaying pressure that continues to exit through the muzzle after the bullet exits. In this initial phase, pressures can reach up to 38,500 psi inside the barrel depending on the cartridge being fired. This very high pressure exerts a force that can be several thousand pounds on the barrel/slide combination. This force accelerates the barrel and slide very rapidly towards the rear of the gun while the bullet is accelerated towards the muzzle in accordance with Newton's Third Law of Motion. During this initial acceleration the force of the recoil spring against the slide/barrel system to resist this rapid acceleration is negligible, as recoil springs typically cannot exert a force much in excess of 15-19 lbs. (pounds), whereas the force on the slide/barrel system due to the internal pressure of the powder deflagration can be 3,000 to 4,000 lbs. In this very short time duration, the slide/barrel system is accelerated to velocities in the range of 200 to 350 in/second.

Phase 2: Unlocking of Barrel from Slide

Once the bullet has left the barrel and traveling downfield on target, the barrel can be detached from the slide. The bullet exits the barrel in 0.0004 to 0.0006 seconds after ignition depending on the cartridge being fired and length of the barrel, and the barrel and slide will have traveled anywhere from 0.04" to 0.09". The barrel/slide group has to travel at least this distance before the barrel starts to unlock in order to make sure the barrel does not start tilting before the bullet leaves it. In the Browning type tilting barrel system, the barrel has an angled section such as a camming protrusion or lug that extends below the breech block of the barrel. An angled cam surface on this camming lug contacts a transversely arranged blocking surface on a camming member such as a cam block, cam pin, or similar component that is attached to or part of the pistol frame. At the moment of contact, the slide/barrel velocity vector is now instantaneously re-directed from moving along the slide axis of travel coinciding with the longitudinal axis of the pistol to moving parallel to the angled cam surface of the barrel and/or cam block and obliquely to the longitudinal pistol axis. This is accompanied by a substantial impact force and instantaneous slowing of the barrel/slide assembly in the direction of slide travel (note sudden instantaneous straight line vertical drop in the slide velocity curve of FIG. 19 from more than 300 in./second to less than 250 inches/second. The barrel now rotates (tilts) about a transverse axis as the angular contact surfaces force the breech end of the barrel to rotate down out of engagement with the slide until the point where the barrel and slide are free of each other at the rear. The engagement between the barrel and slide is typically 0.050" to 0.090".

The designer now faces several choices that, with the original Browning system and modern higher power cartridges, have become increasingly more difficult to balance. The designer must decide: (1) How soon the begin unlocking the barrel from the slide after bullet exit?, (2) How much mass should the barrel and slide be?, (3) What angle should the linear cam be at?, and (4) How much initial engagement between the barrel and slide should there be?

All of these decisions have tradeoffs in the traditional Browning system. The sooner the barrel starts to unlock, the sooner you can alter the slide acceleration. The heavier the barrel/slide system, the smaller the acceleration (and velocity) in accordance with Newton's Second law of Motion F=ma. The steeper the linear cam angle, the more velocity (and energy) is re-directed from the direction of slide travel to along the angle of the linear cam. The more engagement between the slide and barrel, the longer they stay together as a unit, giving more time for the pressures to drop in the barrel so that there is not a lot of pressure and force acting on the slide once the barrel and slide separate. An additional factor that has to be accounted for is that even though the bullet has now left the barrel, there is still high pressure gas in the barrel tube. This pressure still needs to bleed off, so there is still considerable pressure in the barrel for a period of time after bullet exit that will continue to impart a force on the barrel/slide system.

Larger diameter cartridges with higher pressure have more gas that takes longer to bleed off than smaller cartridges, so this makes the tradeoffs harder to manage. If the linear cam angle is too steep, the initial oblique collision force between barrel/slide and the cam pin or cam block becomes too energetic and damage to the gun or reduced service life can result (due to high forces and a lot of flexing and stressing of the frame components). If one starts to unlock barrel from slide too soon, the pressures in the barrel might be too high when the barrel separates from slide, and the now lighter mass of the slide accelerates again substantially after being slowed down even though the slide has separated from the barrel, the cartridge case is being extracted by the slide, and pressure is still acting on the inside of the cartridge case and therefore on the slide. If you unlock the barrel from the slide too late, the initial Phase 1 velocity is so high that the slide is hard to slow down without a steep linear cam angle. A heavier slide/barrel system adversely makes the pistol both heavy and unbalanced in the hand (top heavy). Too much engagement is going to require more vertical height in the action, making a taller gun which is typically not desirable.

Phase 3: Slide Travels Alone

In the last operating phase, the slide (with extracted spent cartridge case) is traveling free of the barrel in the sense that the slide is sliding freely over the muzzle portion of the barrel as it travels linearly to the rear under recoil. The rear breech end of the barrel is out of engagement with the slide and is rotating downwards about a point on the cam block or about the axis of a cylindrical cam pin as applicable. However, depending on the cartridge being fired, there is still some interaction with the pressure that is inside the cartridge case if that pressure is not zero. As the cartridge case is being extracted from the now stationary barrel, the case unseals itself from the barrel chamber and there is now another avenue for the gasses to exit other than through the forward barrel muzzle. However, initially this new opening is quite small, and the decaying pressure still bears primarily on the interior base of the cartridge case, and therefore still exerts a rearward force on the slide even though the barrel and slide are now technically separate from each other. At some point this pressure will decay to zero and the recoil spring will start to exert a non-negligible biasing force on the slide to decelerate it before the slide reaches its full travel at stops on either the frame itself or some intermediate component (like cam block) that transfers the force of stopping the slide through into the frame (and then to the user). The fired cartridge case is removed from the barrel chamber via means of an extractor mounted to the slide. The extractor holds the fired cartridge case to the slide until the slide passes over an ejector towards the end of the slide travel. The cartridge case hits this ejector and is rotated out of the ejection port of the firearm. The slide then finishes its rearward travel and stops on the frame itself or some intermediate component.

Again, all the tradeoffs the designer faces regarding when and how to separate the barrel from slide have an influence on operating Phase 3, as they will influence the amount of kinetic energy the slide has when it stops its rearward motion. This kinetic energy is the primary recoil energy felt by the user and has to be absorbed by the components of the pistol to minimize its impact on the user. If one uses a heavier recoil spring to control the later stages of the slide velocity (once chamber pressure is zero) because it is decided to keep the barrel and slide together longer, or unlock too soon, or use too light a slide, or use too shallow a linear cam angle, then the manual operation of the slide to cycle the action can be difficult for the user due to the high force required to move it. It can also influence whether the pistol functions properly with lower energy cartridges. Too high a final slide velocity will create excessive impact forces that will reduce the service life of the pistol and produce high recoil forces that the user will find unacceptable, or require the pistol to undesirably be increased in size so that components can be made larger and heavier to better absorb the stress of this impact. As one can see, the "optimum" design of Browning's tilting barrel/linear cam system becomes more difficult with larger, more powerful modern cartridges because of the counteracting nature of the tradeoffs. Therefore, a better barrel camming system is needed for firing modern higher power ammunition cartridges that minimizes "felt" recoil on the user and increases the longevity of firearm components.

According to one aspect of the invention, an improved barrel camming system having a variable cam is provided that minimizes felt recoil for use with today's higher power ammunition cartridge. Of course, the variable camming system is not limited in its application to high power rounds alone.

According to one non-limiting embodiment, the barrel variable cam system described herein and shown in the figures takes the basic Browning tilting barrel system and replaces the linear cam with a novel variable cam having a complexly curved, varied, and undulating cam track surface or profile. The variable cam system generally comprises a transversely mounted cam pin in the frame and/or an insert in the frame (whether it be called a cam block, fire control insert, etc.) and a varying cam profile on the barrel that is specifically "tuned" to the interior ballistic curve of the cartridge in question. The variable cam discussed below is not to be confused with a linear cam formed by machining an enclosed slot in a barrel using a round cutting tool. A linear cam of this type will have rounded ends due to the use of a round tool (and may look similar to a variable cam), but the functional cam track surface which engages the cam pin for a majority of the pin's travel through the slot is linear and the round ends of the slot are not a varying cam profile in the manner described herein.

The variable cam according to the present disclosure takes advantage of the fact that advances in the science of interior ballistics and computer processing (per SAAMI—Sporting Arms and Ammunition Manufacturers' Institute—the definition of interior ballistics is "the science of ballistics dealing with all aspects of the combustion phenomena occurring within the gun barrel, including pressure development and motion of the projectile along the bore of the firearm") now provides the ability to create a reasonably accurate simulation of the pressures at the breech of a pistol as they vary both with time and distance; a tool not available to John Browning in the early 1900's. Using this data one can begin to develop a varying cam geometry according to the present disclosure for a cartridge that gets around the tradeoffs previously listed with a strictly linear cam. A variable cam offers the following advantages:

- Ability to start the tilting of the barrel later to keep internal pressures lower at the moment barrel and slide release
- Have a shallower initial cam angle so that the initial impact force of the slide/barrel on the cam pin is lower. Manual operation of the pistol slide by the user is also made easier by a shallow initial angle.
- Allow a steeper final cam angle so that more re-direction of the slide-barrel velocity away from the direction of slide travel occurs, thereby offsetting the higher velocities that occur from starting the tilting of the barrel later. This yields a reduction in slide velocity in Phase 3 compared to a traditional Browning tilting barrel action for the same slide and barrel mass.
- Allows a longer time and distance where the barrel and slide are engaged through the barrel tilting process to further reduce the pressure inside the barrel bore.
- The cam profile can be optimized for a cartridge, so that a barrel chambered for a particular pistol cartridge can have a cam profile "tuned" to give the best results for the different combinations of bullet and powder found within that cartridge.
- More standardization of parts within a pistol family. Since a barrel is unique for a given cartridge chambering, having a barrel with a "tuned" cam to give similar slide velocities regardless of caliber allows more standardization of recoil springs frame inserts, etc. Current firearms with a constant cam angle regardless of caliber have more cartridge specific components like recoil springs, cam blocks, etc. to compensate for the inefficient fixed-angle cam.

The combination of later unlock time, lower initial impact force, steeper final cam angle all combine to create a system that: has lower recoil force as felt by the user; has lower impact forces that need to be absorbed by the pistol; has lighter slide and barrel components to create a more balanced pistol in the user's hand; and has fewer cartridge-specific components.

Referring initially to FIGS. 3-6, the variable camming system includes a barrel camming protrusion or lug 80 that extends downwards from the barrel 60, and preferably from chamber block 63 in one embodiment. Camming lug 80 generally has a rearward swept shape terminating in a rear tip 85. Camming lug 80 defines a cam track such as cam slot 81 including a closed upper terminal front end 82 and opposing lower rear end 83. The front end 82 defines an arcuately curved end surface which is distinct from any active sliding surfaces or curvatures formed along the working portion of the cam slot 101, as further described herein. In one embodiment, rear end 83 is rearwardly facing and open to receive a laterally transversely oriented barrel stopping surface 100 therethrough disposed in or formed on the pistol frame 21. In other possible embodiment, the rear end 83 of the cam slot 101 may be closed and the cam pin 101 may be pre-positioned within the slot at the rear end at all times.

The bottom surfaces of slot 81 defines an angled lower front cam track surface 84 that slideably engages a convexly curved barrel stopping surface 100 of the frame for arresting the motion of the barrel 60 under recoil after discharging pistol 20. Cam track surface 84 may generally be described as facing in upward and rearward directions as shown. The cam track surface 84 is obliquely angled to longitudinal axis LA of the pistol when the barrel is in a horizontal orientation (see, e.g. FIGS. 3 and 4). The top of the cam slot 81 is bounded by an upper rear surface 160.

In one embodiment, barrel stopping surface 100 preferably may be formed on a transversely mounted cylindrical cam pin 101 which may be affixed to intermediate portion 24 of pistol frame 21. In such a configuration, stopping surface 100 may be considered as having an arcuately rounded and convex shape. This facilitates smooth sliding engagement and movement of the pin 101 along the cam track surface 84 of the barrel. Cam slot 83 is configured and dimensioned in cooperation with cam pin 101 for insertion and slideable engagement of the pin with various camming surfaces formed in the slot as further described herein. The closed terminal front end 82 of cam slot 81 may have arcuately curved surfaces in one embodiment with a radius of curvature selected slightly larger than that of cam pin 101 to avoid excessive looseness or movement of the pin in the front end. It bears noting that the arcuately rounded surfaces in the front end 82 of cam slot 81 should not be confused with the active curved sliding surfaces of the cam slot which redirect the motion and angular orientation of the pistol barrel 60 during recoil, as further explained herein.

In one embodiment, cam pin 101 is located below and proximate to the underside of barrel chamber block 63 when the breech is fully closed as shown in FIG. 4. Pin 101 is further positioned immediately rearward of the open ended cam slot 81 as shown for entry into the slot when the pistol is fired. In one embodiment, the chamber block 63 of barrel 60 may rest on and receive support from cam pin 101. It will be appreciated that other forms, shapes, and arrangements of blocking surfaces affixed to or formed as an integral unitary structural part of frame 21 may be provided instead. As one example, the convex stopping surface may alternatively be formed as a lobed shape on the front of a cam block disposed in the frame. Other configurations are possible.

In preferred embodiments, cam track surface 84 has a multi-contoured configuration or profile in which various portions of the track surface 84 may each be oriented at different oblique angles with respect to the longitudinal axis than other portions of the cam track surface. The specific cam profile angles selected for each section of the cam track surface depends on the particular recoil phase of the pistol operation discussed above and angular rotation or tilt of the barrel as it becomes unlocked from the slide 40. The cam track surface 84 accordingly has a cam profile specifically selected and "tuned" to give the best felt recoil and force reduction results possible for the different combinations of bullet and powder found within a particular cartridge for which the barrel is chambered.

Figure 5:
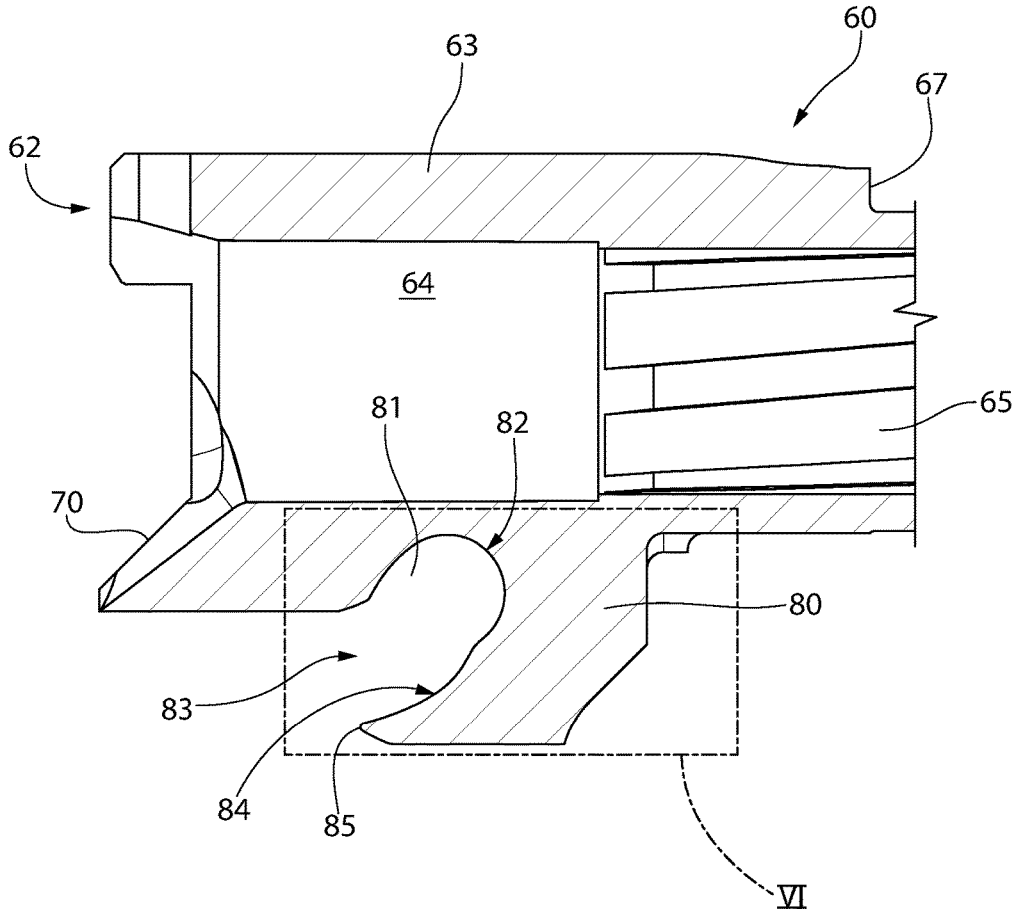
FIG. 5 is a right side partial cross sectional view of the rear breech end of the barrel from FIG. 1 showing the barrel cam slot.
Figure 6:
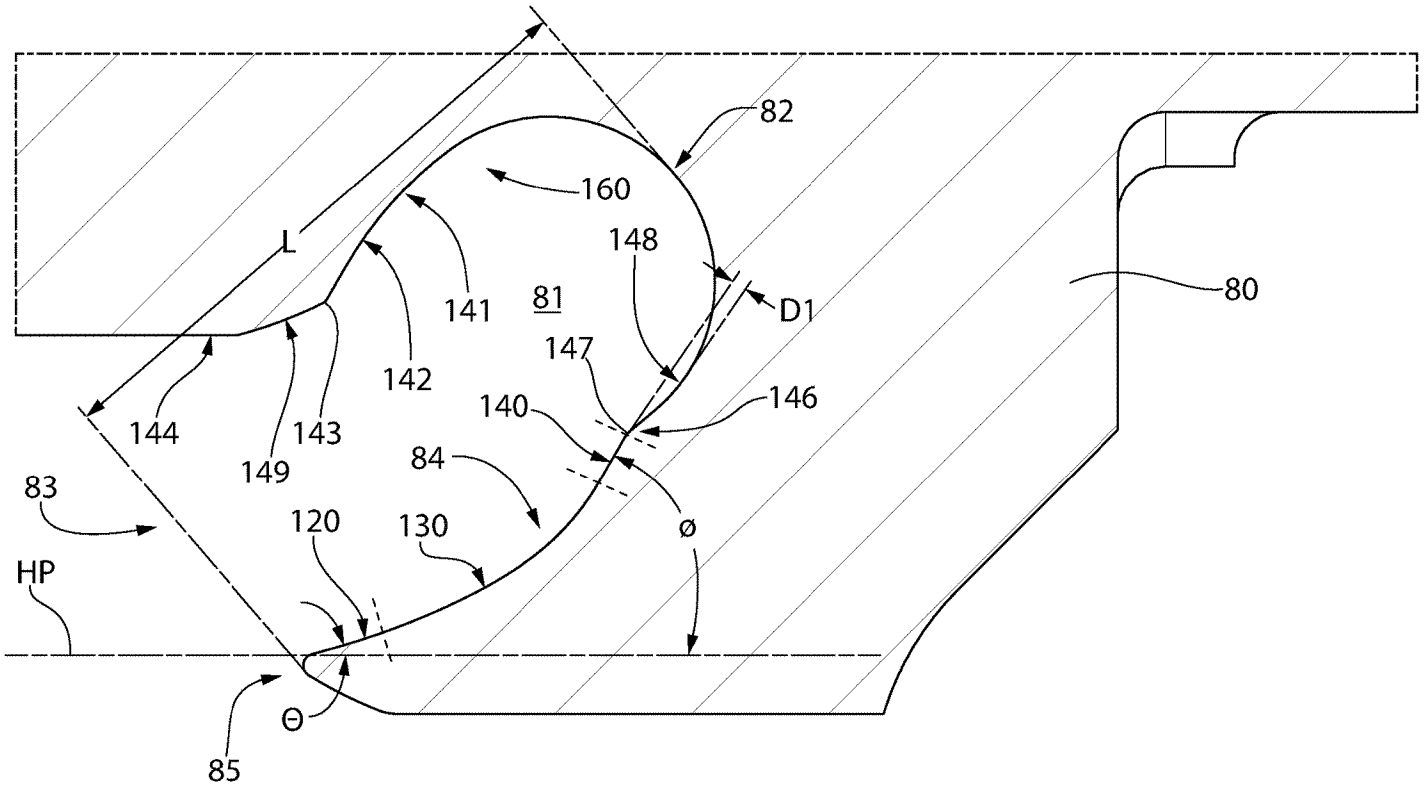
FIG. 6 is an enlarged detail view of the cam slot taken from FIG. 5.

Referring to FIGS. 4-6, the multi-contoured and undulating cam track surface 84 will now be described in more detail. The variable cam on barrel 40 of pistol 20 according to the present disclosure has a cam profile that generally comprises of three components or sections: Initial Contact Section 120, Intermediate Variable Cam Section 130, and Final Cam Section 140 as further described below. For ease of reference, a horizontal reference plane Hp oriented parallel to the longitudinal axis LA of pistol 20 may be defined that intersects the rearmost point at the tip 85 of barrel cam track surface 84 (see FIG. 6). The points of demarcation between these different sections of the cam track surface 84 have been identified in FIG. 6 with dashed lines to facilitate description.

In the following description of the barrel camming system surfaces and their operation, it is easier in some cases to describe the invention in terms of the cam pin 101 movement in and relative to the barrel cam track or slot 81. This approach has been largely adopted below. However, it should be noted that physically during recoil after discharging pistol 20, the barrel 60 is actually moving around cam pin 101, which is a fixed component in the frame 21 of the pistol as previously described.

Initial Contact Section

The initial contact section 120 is that lowermost portion of the cam track surface 84 cam profile that initially contacts the cam pin 101 in the frame or frame insert of the pistol at the beginning of the barrel unlocking sequence. This section begins at the entrance portion of the cam slot 81 defined by the lower rear end 83 of the slot. This section 120 is very small in length, and preferably less than 50% of the total length L of the slot 81, more preferably less than 25% of total length L. Ideally, this initial contact section 120 should be linearly straight and further consist of an angle as close to 0° as is practical to horizontal reference plane Hp, since any non-zero angle (as measured from the horizontal) will result in an oblique impact and instantaneous impact forces being applied to the gun. The simplified formula for an oblique, purely elastic collision between two objects is:

$$\vec{F}_{average} = m\frac{\overrightarrow{\Delta v}}{\Delta t}$$

Where $\vec{F}_{average}$ is the average force vector, $\overrightarrow{\Delta v}$ is the change in the velocity vector, and $\Delta t$ is the duration of impact. For a simplified model of a glancing blow in which the impact is perfectly elastic and the blow merely changes the direction of the velocity vector but not its magnitude, the scalar magnitude of $\overrightarrow{\Delta v}$ is given simply by:

$$\Delta v = 2v \sin(\theta/2)$$

Where $\theta$ is the angle of the ramp or cam track surface measured from the slide axis of travel (i.e. longitudinal axis LA). One would further assume that duration of impact $\Delta t$ remains approximately the same regardless of ramp angle, so that the magnitude of the force only varies as a function of the slide/barrel velocity immediately prior to impact with the cam pin (and hence frame assembly) and the angle of the ramp. While this model is simplified it yields a reasonable approximation of how the variation of the ramp angle affects the initial impact of the slide/barrel and frame assembly if all the other terms are held constant.

A zero degree angle (sine of 0° is 0, or no velocity vector change) is not practical in reality, as the vertical height of the barrel (and gun) would have to increase to do this, and getting a perfect tangential initial contact between the pin and cam would be extremely difficult given practical manufacturing tolerances. However, since the impact force is a direct function of the sine of the angle on the ramp, even an initial angle between 15 and 20 degrees (a practical angle range that balances out gun size and manufacturing tolerances) would yield an initial impact force of ⅓ to ½ of a 45 degree ramp angle (the typical angle used in the Browning tilting-barrel system). Stated another way, the initial impact force of a variable cam ramp system for a pistol can significantly reduce the initial impact between the barrel/slide and frame assembly by approximately 50 to 67%. This would reduce wear and tear on the pistol as well as reduce substantially one component of felt recoil. A shallower initial ramp angle also makes the pistol easier and smoother to manipulate manually by the user.

Accordingly, in one embodiment, the initial contact section 120 of cam track surface 84 has a cam profile that is linearly straight with an angle θ to horizontal reference plane Hp that is preferably less than 45 degrees, and more preferably less than 30 degrees. In one example, without limitation, angle θ may be about and including 15 to 20 degrees measured to horizontal (i.e. horizontal reference plane Hp) for optimal initial contact force reduction between the cam pin 101 and the barrel cam lug 80. The initial contact section 120 defines a flat surface that engages the cam pin 101 and directs it motion during initial engagement of the pin with the cam track surface 84.

Intermediate Variable Cam Section

Figure 21:
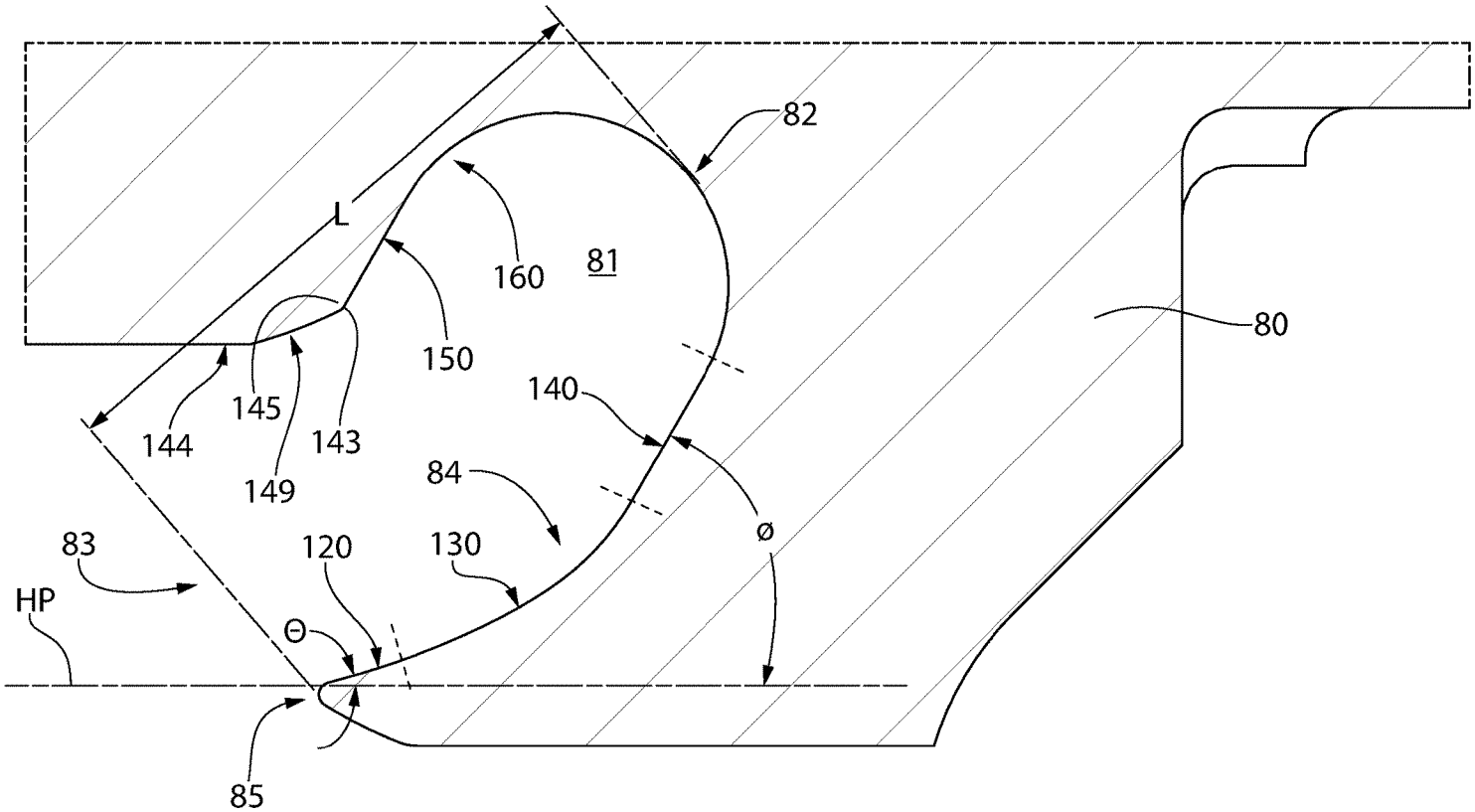
FIG. 21 is an enlarged detail view of the cam slot taken from FIG. 20.

The intermediate variable cam section 130 (also referred to herein as simply variable cam section for brevity) is where the camming surface of the barrel is used in conjunction with the cylindrical cam pin 101 to create a path through which the slide/barrel velocity is gradually re-directed from the linear direction of slide travel to the final cam angle. In a preferred embodiment, variable cam section 130 has an arcuately curved concave shape formed in cam track surface 84 that faces and engages the cam pin 101. The intermediate variable cam section preferably has an arcuately curved surface with a varying radius of curvature, or may have a constant radius of curvature in other embodiments. The variable cam section 130 shape can vary to suit the desired rate of re-direction of the slide/barrel velocity. It can be a single constant radius, multiple sections tangent to each other with each section having a constant radius, or a continuous flowing curve defined by a polynomial, trigonometric, or piecewise spline function. In one preferred embodiment as illustrated in FIGS. 6 and 21, variable cam section 130 may have a concavely curved constant radius providing a continuously variable cam track surface 84 which changes from the lowermost portion of the cam section 130 directly adjoining the linear initial contact section 120 to the uppermost portion of cam section 130 adjoining the final cam section 140. The point of demarcation between the initial contact section 120 and variable cam section 130 is the point where the cam track surface 84 begins to curve and departs from the linearly straight surface of the initial section such that a point on the cam track surface will no longer lie in the same linear plane as the initial contact section 120.

The choice of the shape of the curve is dictated in large part by the interior ballistic data for the cartridge and the desired dimensions of the pistol. A very long, gently curving cam would ideally be the best, as it would give the most time for the re-direction to happen and pressures to drop, but physical space constraints in the pistol action dictate the extent to which that is achievable. The angular difference between the initial contact section and the final ramp angle section will also affect how gradual the curve can be.

Final Cam Section

This final cam section 140 of the variable cam surface on the barrel is the final angle that achieves the desired slide velocity along the slide axis of travel at the point where the barrel 60 and slide 40 release from each other. In some embodiments illustrated in FIGS. 6 and 21, the final cam section 140 may have a straight linear profile forming a flat surface. In theory, the point at which the camming section and final cam section meet would be timed right at the point of barrel/slide separation, but as a practical matter this would be difficult to achieve with manufacturing tolerances. Therefore, the point at which the variable cam section 130 and final cam section 140 meet should be slightly before the barrel/slide separation point so that one is sure the barrel/slide assembly decelerates to the desired velocity along the slide axis of travel before separation. After the barrel 60 and slide 40 separate, the barrel will continue to travel down at this final angle (obliquely to longitudinal axis LA) until the barrel fully stops on the cam pin 101 and its motion is arrested. The downward motion of the barrel 60 uncouples the barrel from the slide 40 allowing the slide to continue rearward on its own during recoil.

The length of the final cam section 140 may be varied depending on the configuration of cam slot 81. One configuration of cam slot 81 is shown in FIGS. 4-6 and defines what is referred to herein as an S-shaped curve cam. A second embodiment of the cam slot and final cam section 140 is shown in FIGS. 18-21. This latter configuration is described first below followed by the S-shaped curve cam which will be described later.

Final Cam Section—Cam Surfaces without Undercut Surface

Referring to FIGS. 18-21, cam track surface 84 of the final cam section 140 in this embodiment may have a straight linear profile. This defines a flat surface that engages the cam pin 101 and directs it motion during the final stage of arresting the barrel's motion. The cam track surface 84 in the final cam section 140 is preferably disposed at an angle φ of less than 75 degrees and more than 25 degrees to horizontal reference plane Hp, and more preferably less than 60 degrees and more than 30 degrees. In one implementation, angle φ may be about 45 degrees. The angle of the final cam section 140 selected depends on the desired final slide velocity under recoil after the slide 40 separates from the barrel 60. Generally, the steeper the angle, the more reduction in longitudinal slide velocity occurs, and vice-versa. The point of demarcation between the intermediate variable cam section 130 and the cam section 140 is the point where the cam track surface 84 begins to curve and departs from the curvature of the variable cam section such that a point on the cam track surface will no longer lie along the same radius of curvature as the variable cam section 130.

In this embodiment, it bears noting that the upper rear surface 160 of the cam slot 81 comprises a rear angled section 149 and an adjoining front angled section 150 which terminates at the start of the concavely curved surface of the closed front end 82 of the cam slot. Both the rear and front angled sections 149, 150 each have a linear straight cam profile and are disposed at different oblique angles to the longitudinal axis LA and horizontal reference plane Hp. This contrasts to the re-direction surface 141 of the cam slot embodiment shown in FIGS. 4-6 which has an arcuately curved concave cam profile. Other angles may be used. The front section 150 of upper rear surface 160 of cam slot 81 may be substantially parallel to the linear or flat final cam section 140 of the cam track surface 84 in this embodiment.

Figure 20:
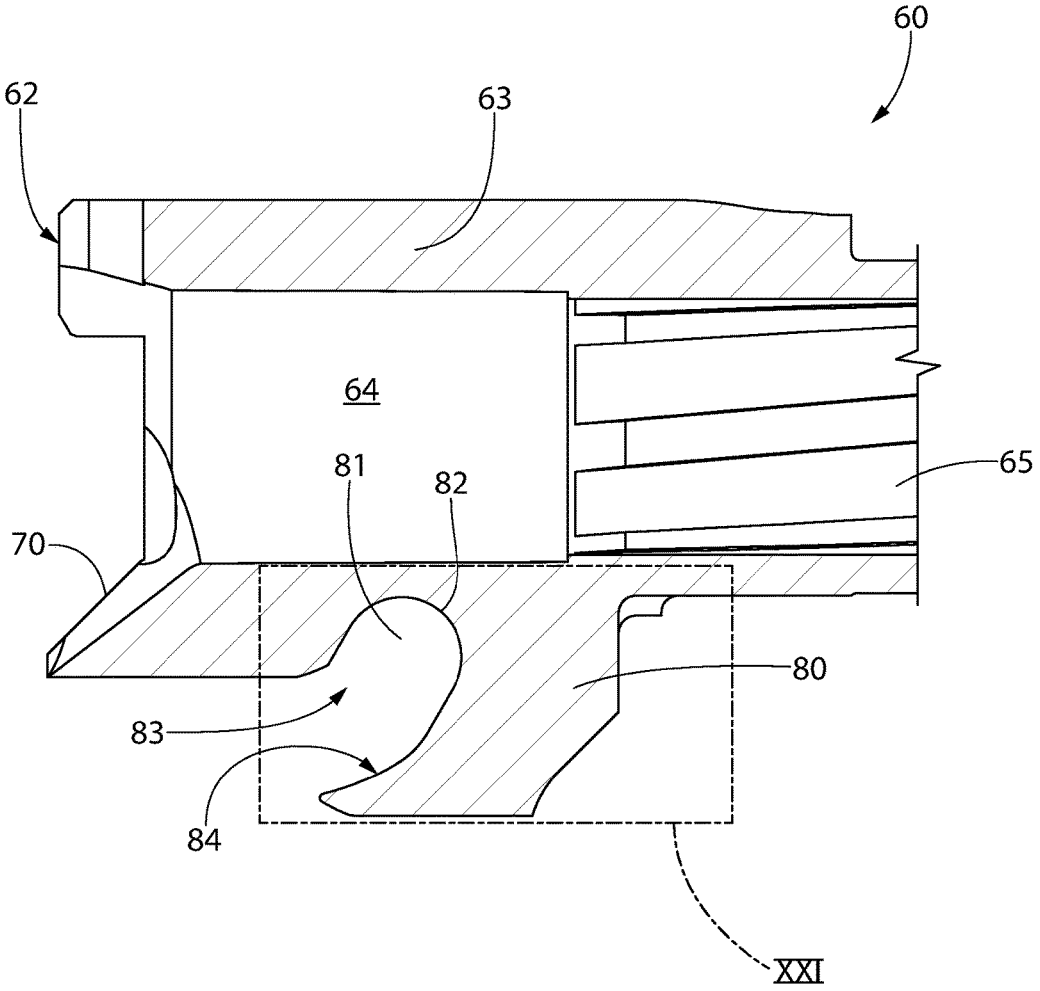
FIG. 20 is a right side partial cross sectional view of the rear breech end of the barrel from FIG. 1 showing a second embodiment barrel cam slot.

In this embodiment, the final cam section 140 of cam track surface 84 has an extent and length extending from the forward end of the concave variable cam section 130 to the start of the closed terminal front end 82 of the cam slot 81 as best shown in FIGS. 20 and 21. The flat linear surface of the final cam section 140 transitions into the arcuately curved surfaces which define the front end 82 of the slot.

In short, the variable cam system having a final cam section 140 profile shown in FIGS. 20 and 21 thus may be summarized as collectively comprising a linear initial cam section 120, an arcuately curved concave intermediate variable cam section 130 directly adjoining cam section 120, and a linear final cam section 140 directly adjoining section 130 forming a structurally contiguous cam track surface 84 between the sections that slideably engages cam pin 101.

Final Cam Section—S-Shaped Curve Cam Surfaces with Undercut Surface

Referring to FIGS. 4-6, the S-shaped curve cam embodiment of the final cam section 140 can be used for larger, higher pressure cartridges which defines a "jog" at the termination of the variable cam section 130 cam track surface and abrupt change in direction of the cam pin 101 during the slide and barrel separation process of the firing sequence. This "jog" forms something similar to an S-shaped curved cam track and path of travel for the cam pin 101 as it moves upwards within the cam slot 81. In the John Browning type of cam track and its adaptations, the active camming surface which slideably engages and directs the motion and direction of the cam pin (and thus motion of the barrel) is substantially the bottom or lower surface of the cam slot. The upper or top surfaces of the Browning type cam track play no significant role in this regard and merely keeps the cam pin bounded at the top to prevent excessive motion or looseness of the pin in the cam track slot. These upper surfaces may thus be considered as "inactive surfaces" which do not substantively contribute to changing the direction of the cam pin or barrel.

In the embodiment shown in FIGS. 20 and 21 described above, at the point where the variable cam section 130 comes up to the final cam angle φ of the linear front cam section 140 and stays at that angle to the end of the cam track, the barrel will create an impact once it bottoms out on the cam pin in the cam slot 81. It will be recalled that the variable cam system allows the re-direction more of the slide velocity vector from in-line with the barrel bore axis (e.g. longitudinal axis LA) to the final cam angle φ than a traditional Browning tilting barrel system. The conservation of momentum states that the momentum (mass×velocity) of a closed system is constant through time regardless of changes within the system. If one simplifies the pistol so that the frame is held rigidly, friction is ignored, and you analyze it after the bullet has left it becomes essentially a closed system. Therefore you have the following:

$$m_{slide+barrel}\vec{v}_{slide+barrel} >> \text{(camdown \& separation)} >> m_{slide}\vec{v}_{slide} + m_{barrel}\vec{v}_{barrel}$$

where $\vec{v}$ is the velocity vector of the component and m is the mass. One can see that, in order to keep this equation equal if you slow down the slide velocity you must increase the barrel velocity in order to keep the momentum constant. Although this is a simplification (in reality once the barrel/slide assembly contacts rest of the gun by means of the cam pin you start moving the rest of the pistol and the arm(s) of the person holding it) it illustrates nicely the concept of momentum conservation and that the more you slow down the slide during camdown the faster you speed up the barrel. If this velocity increase of the barrel becomes excessive now, the rapid stopping of the barrel against the cam pin can generate excessive impact forces and shock on the rest of the pistol. In essence, one has shifted where, when, and how the camdown shock is being transmitted to the rest of the gun.

The S-shaped curve cam embodiment shown in FIGS. 4-6 describes a method to attenuate this impact of the barrel 60 against the cam pin 101 in cases where the desired reduction of slide 40 velocity results in excessive barrel velocity and impact force. In essence, another second oblique impact is created, this time between the barrel 60 and cam pin 101, so that the barrel would be forced to track along another different curve and surface separated from cam track surface 84 that operates to bleed off the velocity in a more managed manner. The specific geometry would be dependent on the shape of the variable cam section 130 and final angle φ of the final cam section 140, but the general design concept would be as follows.

The S-shaped cam final cam section 140 in this embodiment begins right at about the point on the cam track where the slide and barrel would separate under recoil. This coincides with the front end of the concave intermediate variable cam section 130. Up until this point, both sides of the cam track (cam slot 81) in the barrel 60 have been substantially parallel to one another. In this embodiment, there is a short linearly straight and flat inflection surface 142 and a forwardly adjoining re-direction surface 141 on the top side of the cam track of the barrel 60 on the upper rear surface 160 of cam slot 81. In one embodiment, inflection surface 142 is parallel to final cam section 140 of the lower front cam track surface 84. Re-direction surface 141 operates to further slow the barrel/slide assembly down to gradually dissipates the kinetic energy of the barrel under recoil. This upper re-direction surface 141 may be radial, trigonometric, a polynomial, a piecewise spline, or a combination thereof. In one embodiment, the re-direction surface 141 has an arcuately curved concave shape, which may be of constant radius in some configurations or of a varying radius of curvature in other embodiments. The re-direction surface 141 changes the concavity of the upper rear surface 160 of the cam slot 81, and the very slightly angled inflection point 143 on this upper rear surface is where the inflection surface 142 starts and departs from the convexly curved arcuate surface 149 of the upper rear surface 160 immediately behind the inflection surface.

At some point along the re-direction surface 141 during recoil of the barrel-slide assembly, the barrel 60 (which had up to this point been traveling approximately parallel to the final cam section 140 angled surface on the lower front cam track surface 84 of the cam track via engagement with cam pin 101) will contact the cam pin 101 in a second oblique impact (the first oblique impact being the initial cam section 120 on the cam track surface 84 making first contact with cam pin 101 as described above). This second impact will bleed off some velocity and energy from the barrel 60 and force the barrel to start rolling along this re-direction surface in sliding engagement and tilting further. The redirection surface 141 on the upper rear surface of cam slot 81 is therefore an active surface which redirects the cam pin 101 and motion of the barrel 60.

Depending on the design of the variable cam, cam pin size, and clearance between the cam pin and barrel cam track, the re-direction surface 141 may span anywhere from about and including 20 to 60 degrees of arc and its center will be approximately at the point on the barrel cam lug 80 where the barrel and slide separate. The radius of curvature of this redirection surface 141 preferably is larger, and more preferably is substantially larger than the cam pin radius in order to give as much surface as possible for sliding engagement and re-direction of the cam pin 101 travel path.

The re-direction surface 141 smoothly transitions into and terminates at the front where it blends into the arcuately curved closed front end 82 of cam slot 81. The concavely curved surfaces of the front end 82 of the slot then smoothly transition into a concave undercut surface 148 formed in the lower front cam track surface 84 on the barrel cam lug 80 (see, e.g. FIG. 6). Undercut surface 148 is therefore disposed immediately between the final cam section 140 on the cam track surface 84 and the arcuate front end 82 of the cam slot 81. In one embodiment, a raised convexly shaped lower protrusion or prominence 146 defining an apex 147 on the cam slot 81 projects upwards from the lower cam track surface 84, thereby forming a point of demarcation between the final cam section 140 of cam track surface 84 which at its front end terminates at the apex of prominence 146 and the undercut surface 148 forward of the prominence. Prominence 146 is formed by the machining and undercutting of the cam track surface 84 to form the concavely shaped undercut surface 148 which leaves the prominence remaining in relief.

During the forward travel of the cam pin 101 in the cam slot 81, momentum causes the barrel to travel essentially parallel to the linear surface of final cam section 140 on the bottom until stationary cam pin 101 leaves section 140 to engage and slide along inflection surface 142 and re-direction surface 141 of the barrel. The cam pin 101 then continues to move forward along the upper re-direction surface 141 towards the closed front end 82 of the cam slot 81 and down into the lower undercut surface 148. In this motion, it is notable that the cam pin 101 initially skips over the undercut surface 148 which in only substantially engaged by the cam pin 101 after traveling along the upper inflection and re-direction surfaces 142, 141 and through the closed front end 82 of the slot. The undercut surface 148 may be radial, or a combination of radial, linear, trigonometric, polynomial, or a piecewise spline. In the illustrated embodiment, the undercut surface 148 has an arcuately concave shape of constant radius. The undercut surface 148 radius of curvature must be equal to or larger than the cam pin radius in preferred embodiments because if it is smaller the cam pin would wedge itself into that smaller slot and bind the barrel. The barrel 60 is able to slide around the cam pin 101 from the re-direction surface 141, around the front end 82 of slot 81, and then into and along undercut surface 148. The barrel is able to roll or circulate around the cam pin 101 along re-direction surface 141, front end 82 surface, and undercut surface 148 to dissipate energy in a gradual manner so that there is no one single large final impact when the motion of the barrel 60 is fully arrested. This allows the barrel to come to rest on the cam pin 101 with lower impact forces.

The rear termination point of the undercut portion or surface 148 of the cam track will intersect the front of the final cam section 140 (i.e. at the apex 147 of prominence 146) approximately at the point where the barrel and slide would separate during the recoil process or higher as to ensure that the slide sees the maximum reduction in longitudinal velocity. Undercut surface 148 has an undercut depth D1 measured between the apex of the lower prominence 146 to the lowest point on the undercut surface 148. Undercut depth D1 represents the distance of the undercut surface below the final cam section 140 at its highest point coinciding with the apex of prominence 146. The maximum undercut depth relative to the angle φ of final cam section 140 optimally may range between and including about 0.01 to 0.06 inches, and is dependent on shape of the variable cam section 130 and the final cam section 140 angle.

In this embodiment of an S-shaped curve cam, the flat linear surface of final cam section 140 of cam track surface 84 has an extent and length extending only from the forward end of the concave variable cam section 130 to the apex of the lower prominence 146 on the cam track surface as best shown in FIGS. 5 and 6, not all the way forward to the closed front end 82 of the cam slot 81 as in the embodiment shown in FIGS. 20 and 21. The length of the final cam section 140 for the S-shaped cam is therefore shorter than that of the embodiment shown in FIGS. 20 and 21. The undercut surface 148 disposed between the final cam section 140 and the closed front end 82 of the slot in the S-shaped cam embodiment accounts for the remaining distance between the final cam section and the front end 82. It bears noting that for the S-curve cam, the intermediate variable cam section 130 has a greater surface extent and length than either the initial or final cam sections 120, 140. This is due to the fact that the variable cam section 130 contributes the most to rotating and re-orientating the barrel 60 about cam pin 101 to uncouple the barrel from the slide 40.

In the S-shaped curve cam embodiment, the upper rear surface 160 of cam slot 81 comprises (from rear to front) downward and forward facing top variably curved convex surface 149 (noting surface 149 is the opposing offset of 120 and 130) between the inflection surface 142 and horizontal bottom surface 144 of the chamber block 63 disposed between the cartridge feed ramp 70 and the cam slot 81. Variably curved surface 149 is offset of surfaces 120 & 130 and facilitates transition of cam pin 101 from engagement of its bottom stopping surface 100 with the final cam section 140 on the lower cam track surface 84 to engagement thereafter on its top stopping surface with the upper re-direction surface 141 disposed at the top of the cam slot 81. Accordingly, the concavely curved upper re-direction surface 141 of the cam slot 81 in the present embodiment is distinguishable from the angled linear straight upper rear surface 142 of the cam track embodiment shown in FIGS. 20 and 21 described above.

In short, the variable cam system having a final cam section 140 profile with the S-shaped curve cam shown in FIGS. 4-6 may be summarized as collectively comprising a linear initial cam section 120, an arcuately curved concave intermediate variable cam section 130 directly adjoining cam section 120, a linear final cam section 140 directly adjoining section 130, and an additional concave undercut surface 148 directly adjoining the final cam section 140 forming a structurally contiguous lower cam track surface 84 between the sections and undercut surface that slideably engage cam pin 101. The upper rear surface 160 of the S-shape curve cam is denoted primary by the addition of the re-direction surface 141 which causes the cam pin 101 to circulate around the upper surface of the cam slot forward and then downward into the undercut surface 148, and back again between these surfaces until the motion of the barrel 60 is fully stopped. The combination of these upper and lower surfaces collectively cause the cam pin 101 to travel in an S-shaped path from rear to rear of the cam slot 81 which advantageously gradually dissipates the kinetic energy of the barrel 50 under recoil until its motion is finally arrested with less force and felt recoil. In testing performed by the inventor, the S-shaped curve cam advantageously significantly reduce the recoil force imparted to and increased the longevity of the firing mechanism parts in comparison to embodiment without the S-shaped cam.

A method for operating a firearm and controlling barrel movement under recoil with the S-shaped curve cam will now be briefly described. Reference will be made to FIGS. 3-4 and 7-16 which show sequential positions of the barrel-slide assembly of pistol 20 and cam pin 101 in the cam slot 81 under recoil after the pistol is fired via a trigger pull.

The process begins by providing the pistol 20 in the ready-to-fire condition shown in FIGS. 3-4 with the striker 28 cocked and a cartridge C chambered. The breech (breech area 45) is closed with breech face 44 of slide 40 in battery with rear breech end 62 of barrel 60 as shown. The barrel and slide locking surfaces 67, 66 are mutually engaged thereby coupling the barrel to the slide for initial movement in unison as a unit. Cam Pin 101 contacts/is in close proximity to bottom surface 144 of the barrel 60 and keeps the barrel moving parallel along longitudinal axis LA until it reaches the cam track. Momentum and friction between locking surfaces 66 and 67 on the slide and barrel will then keep the barrel moving horizontally until the cam pin contacts surface 120 of the cam on the barrel. The barrel 60 is horizontal and bore 65 is coaxially aligned with the longitudinal axis LA of the pistol. The cam pin 101 is positioned immediately to the rear of cam slot 81 at this phase.

Figure 7:
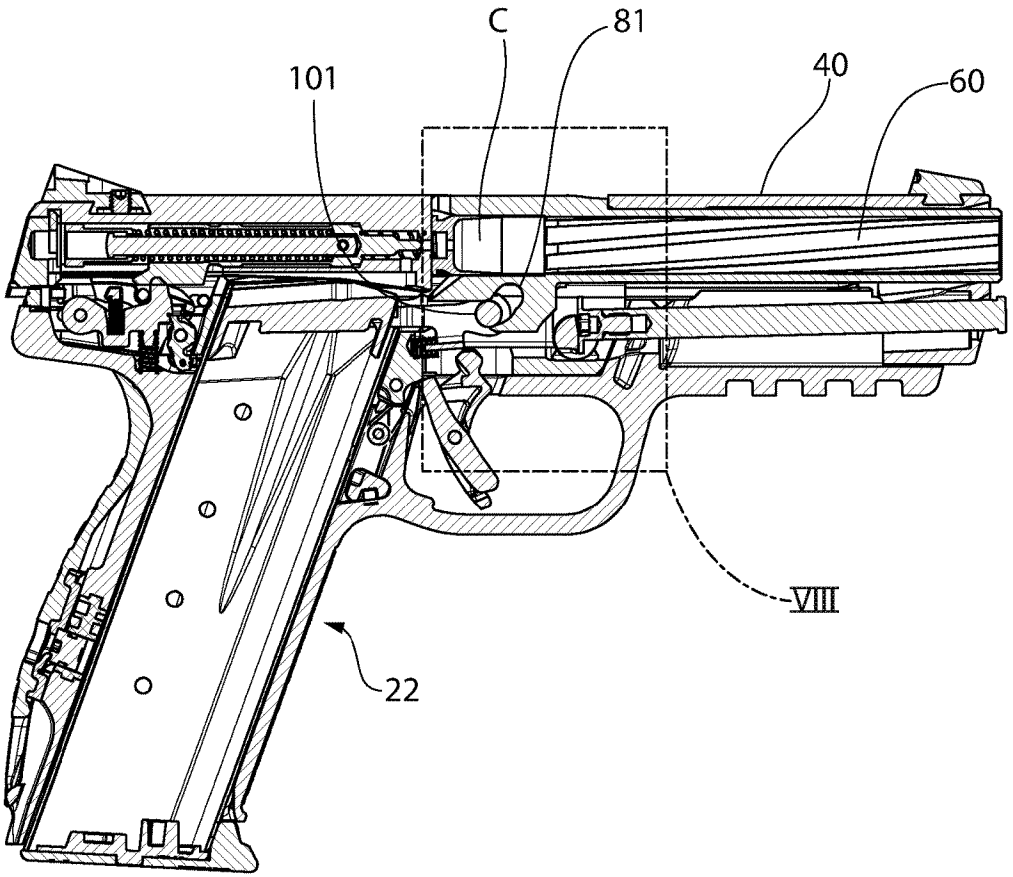
FIG. 7 is a right side cross sectional view of the pistol with the action shown in a first recoil position immediately after firing in which the pistol and the barrel-slide assembly are coupled and traveling rearward together.
Figure 8:
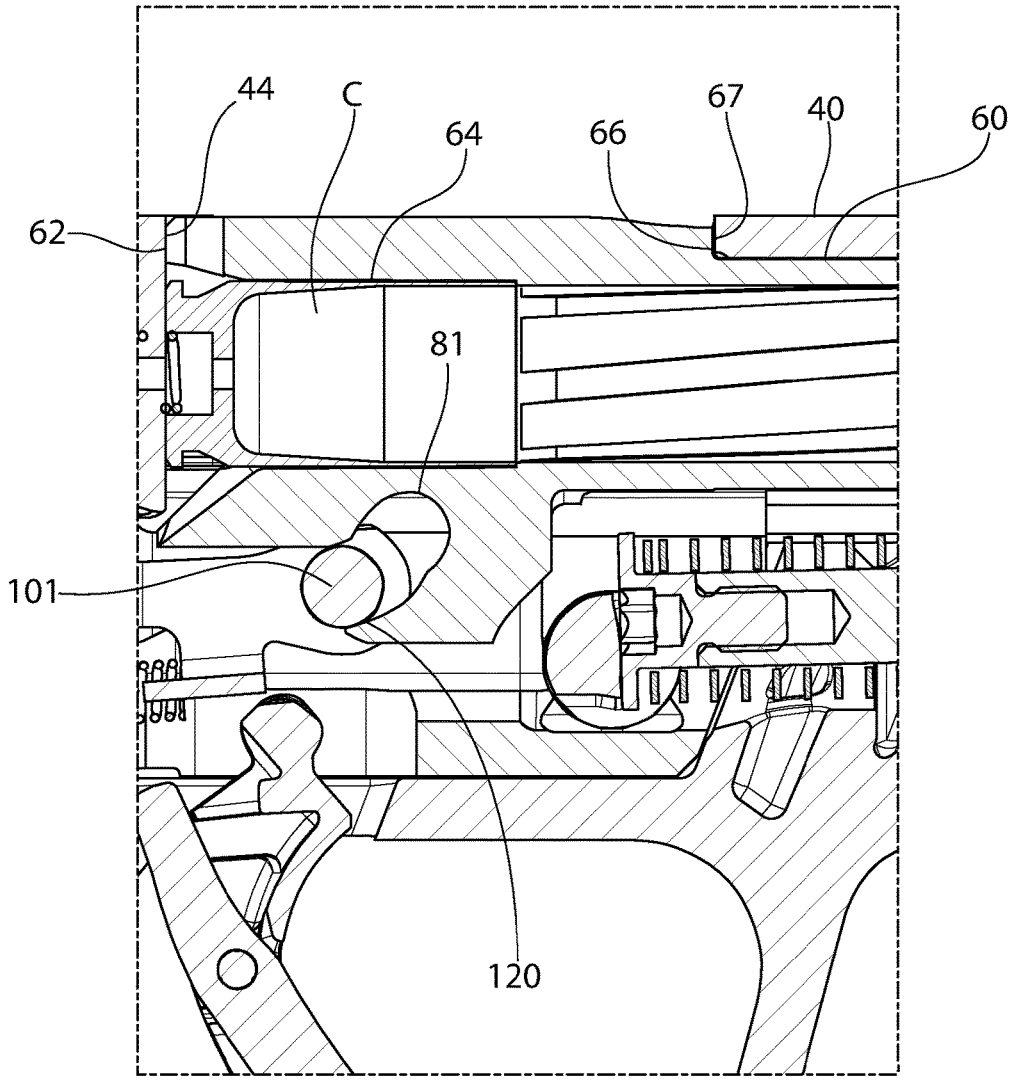
FIG. 8 is an enlarged detail from FIG. 7 showing the cam pin in a first position in the cam slot.

Referring to FIGS. 7 and 8, the firing mechanism 26 is then actuated via pulling trigger 27 in the usual manner. The barrel and slide assembly 60/40 begins to initially travel rearward together under recoil for a distance (note rear end 51 of slide displaced from frame 21 at rear of pistol). Breech area 45 remains closed at this point. The cam pin 101 make initial oblique contact with the linear initial cam section 120 of cam track surface 84 and the pin slides sliding forward along this initial cam section. The barrel 60 remains substantially in a horizontal orientation. Accordingly, the angle of the first cam section of cam track surface 84 does contribute to significantly rotate the barrel 60 about the cam pin 101.

Figure 9:
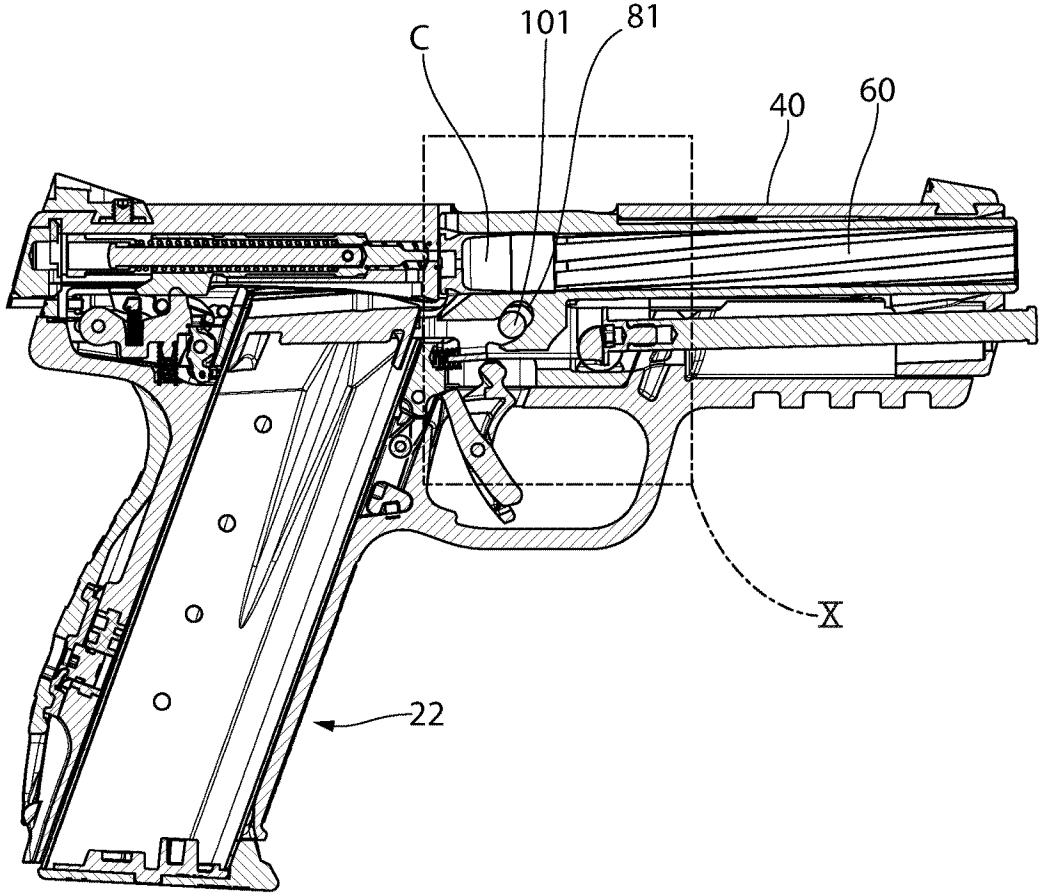
FIG. 9 is a right side cross sectional view of the pistol with the action shown in a second recoil position.
Figure 10:
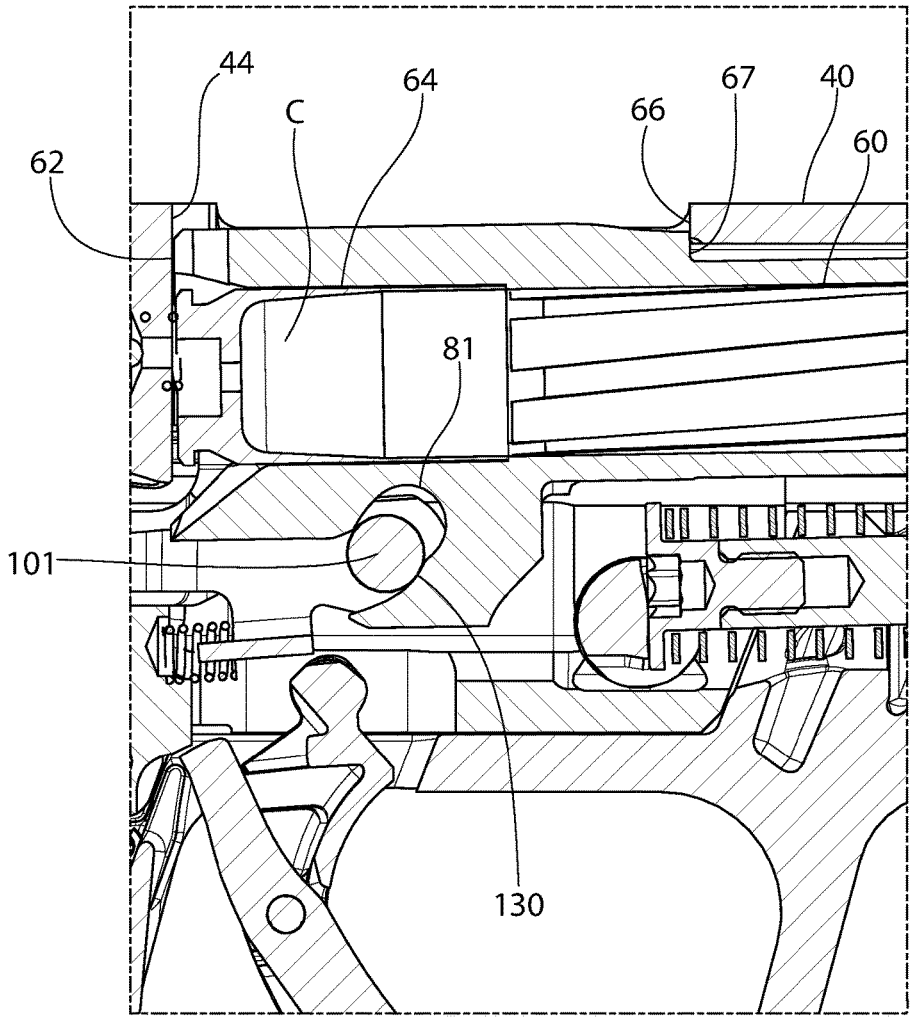
FIG. 10 is an enlarged detail from FIG. 9 showing the cam pin in a second position in the cam slot.

Referring to FIGS. 9 and 10, the barrel and slide assembly 60/40 continues to travel rearward together. The cam pin 101 now engages and slides along the concave intermediate variable cam section 130 of the cam track surface 84. Although the breech area 45 remains substantially closed, the curvature of variable cam section 130 and arcuate travel path of cam pin 101 along this concave surface causes the rear breech end 44 of the barrel 60 to begin rotating downwards substantially about an axis of rotation coinciding generally with the intersection point of the barrel hole in the front of the slide 40 and the centerline axis of the barrel bore 65 in the cylindrical portion of the barrel. Note that this point is continually moving as the slide continues to move to the rear relative to the barrel during the cam down process. Only once the barrel is fully cammed down and front end surface 82 and undercut surface 148 are resting on cam pin 101 does the barrel axis of rotation coincide with the cam pin axis. It bears noting that the majority of the barrel rotation is achieved in the concave variable cam section 130. The muzzle end 61 of barrel 60 rotates in turn upwards. This rotational movement in turn displaces the rear end of the barrel vertically downwards which slides along the breech face 44 of the slide 40. The barrel 60 is no longer perfectly horizontal, but angled in orientation with respect to longitudinal axis LA. The locking surfaces 66, 67 of the slide and barrel remain engaged, but are noticeably more vertically displaced and offset with respect to each other as shown than in the previous position. The rear breech end 62 of the barrel continues to rotate downwards as the cam pin 101 progressively tracks forward along the variable cam section 130 of the cam track surface 84.

Figure 11:
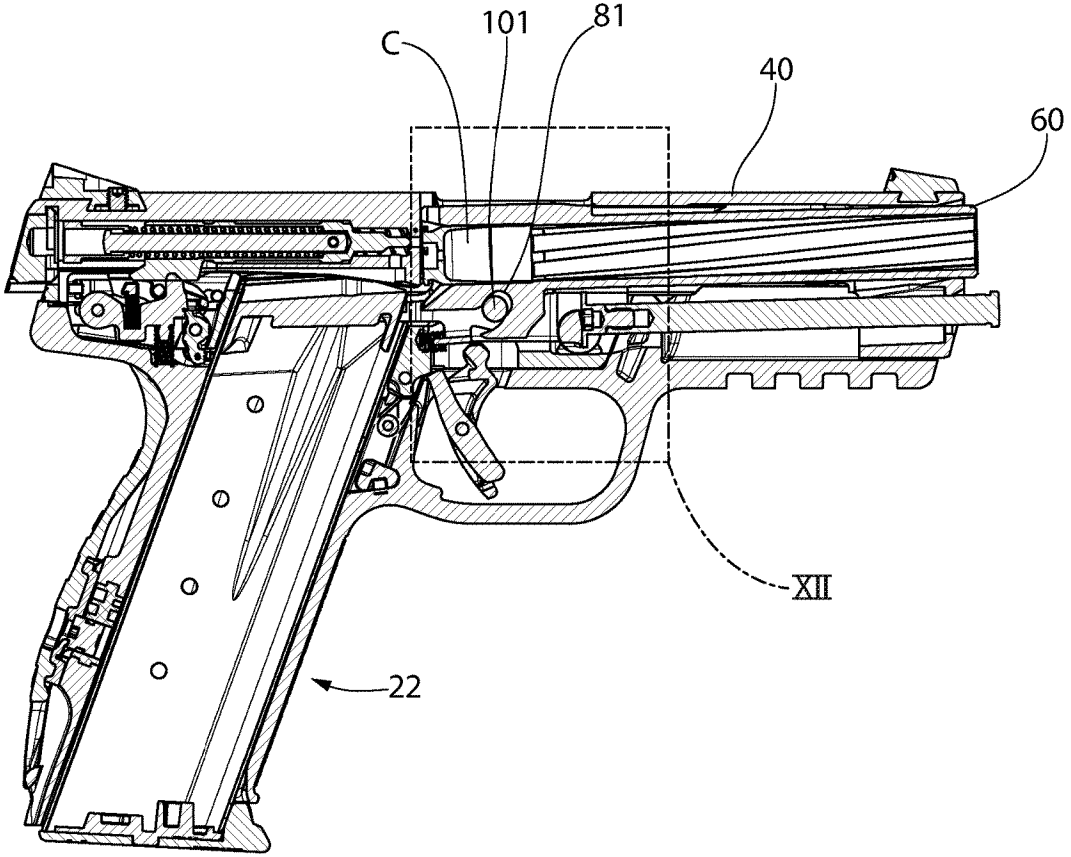
FIG. 11 is a right side cross sectional view of the pistol with the action shown in a third recoil position.
Figure 12:
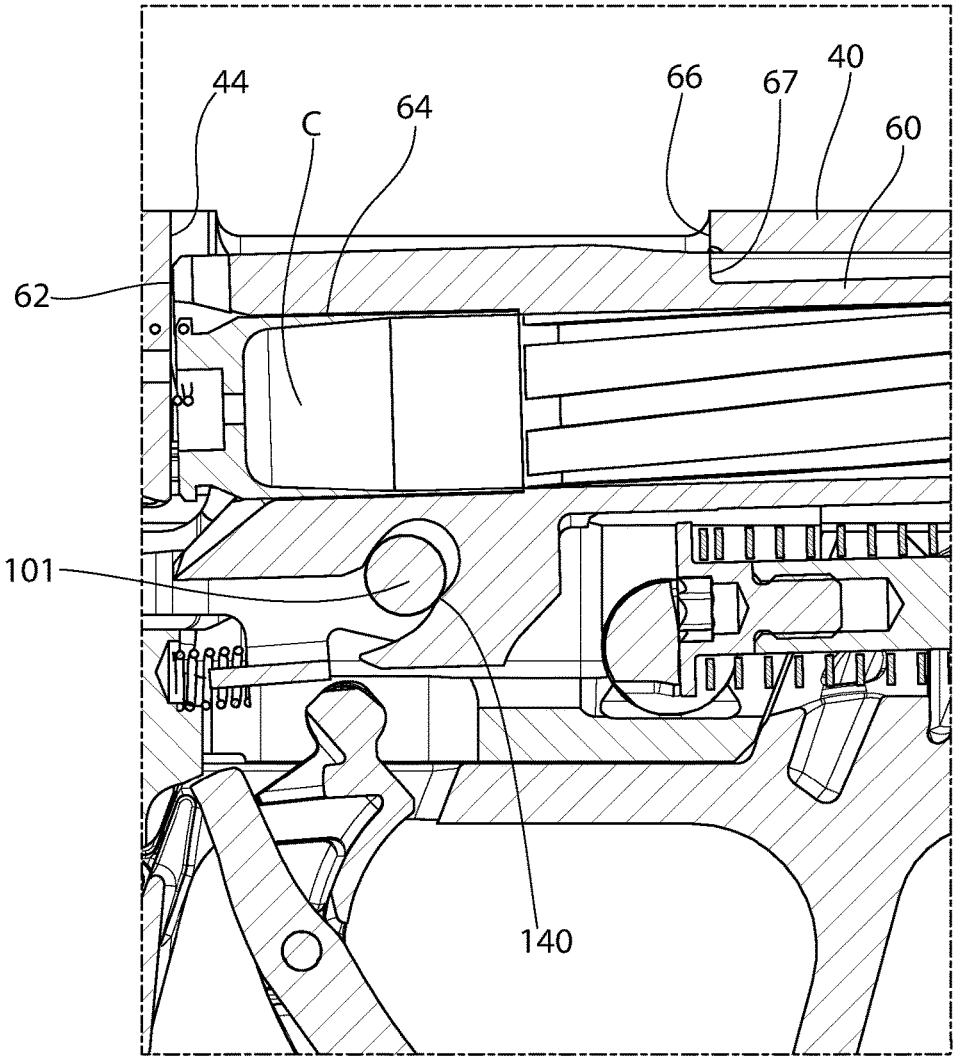
FIG. 12 is an enlarged detail from FIG. 11 showing the cam pin in a third position in the cam slot.

Referring to FIGS. 11 and 12, the barrel and slide assembly 60/40 continues to travel rearward together until approximately slightly after or at the time that the cam pin 101 leaves the variable curve section 130 and engages the linear final cam section 140 of the cam track surface 84, at which point the barrel separates from the slide as described above under the Final Cam Section header. Contact is broken between the mating engaged locking surfaces 66, 67 of the slide and barrel, which operably uncouples the barrel from the slide so that the slide can continue to travel rearward alone under recoil (noting that the barrel still contacts the slide where it protrudes through the front hole in the slide, but the geometry and clearance is such that it is essentially a free-sliding joint). FIG. 12 shows these locking surfaces at the very moment immediately before contact is broken. The cam pin 101 progressively slides forward along the final cam section 140 of the cam track surface 84 as the slide travels rearward causing the rear end of the barrel to rotate downwards more. The breech area 45 opens during this process so that the breech face 44 of the slide 40 is no longer in battery with the barrel. The barrel will continue movement downward in a linear direction coinciding with the angle 4 selected for the final cam section 140 without further substantial rotation or change in orientation due to the flat engagement surfaces in contact with the cam pin 101.

Figure 13:
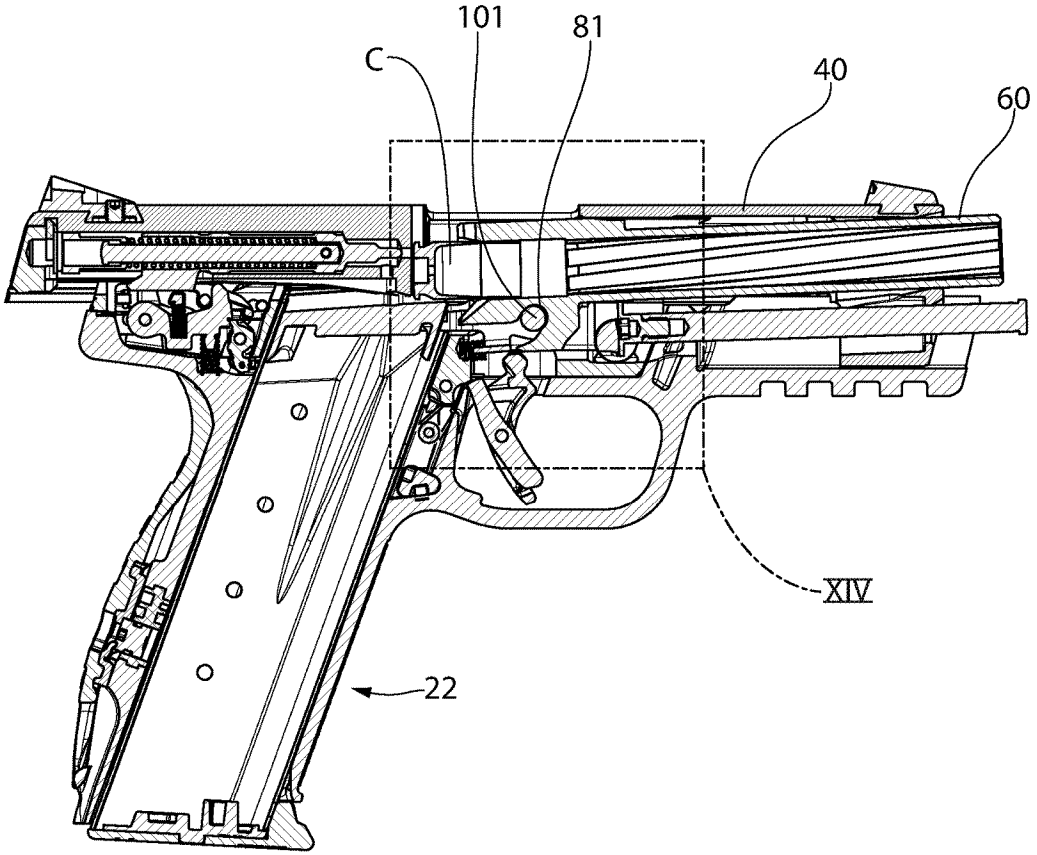
FIG. 13 is a right side cross sectional view of the pistol with the action shown in a fourth recoil position with the barrel uncoupled from the slide.
Figure 14:
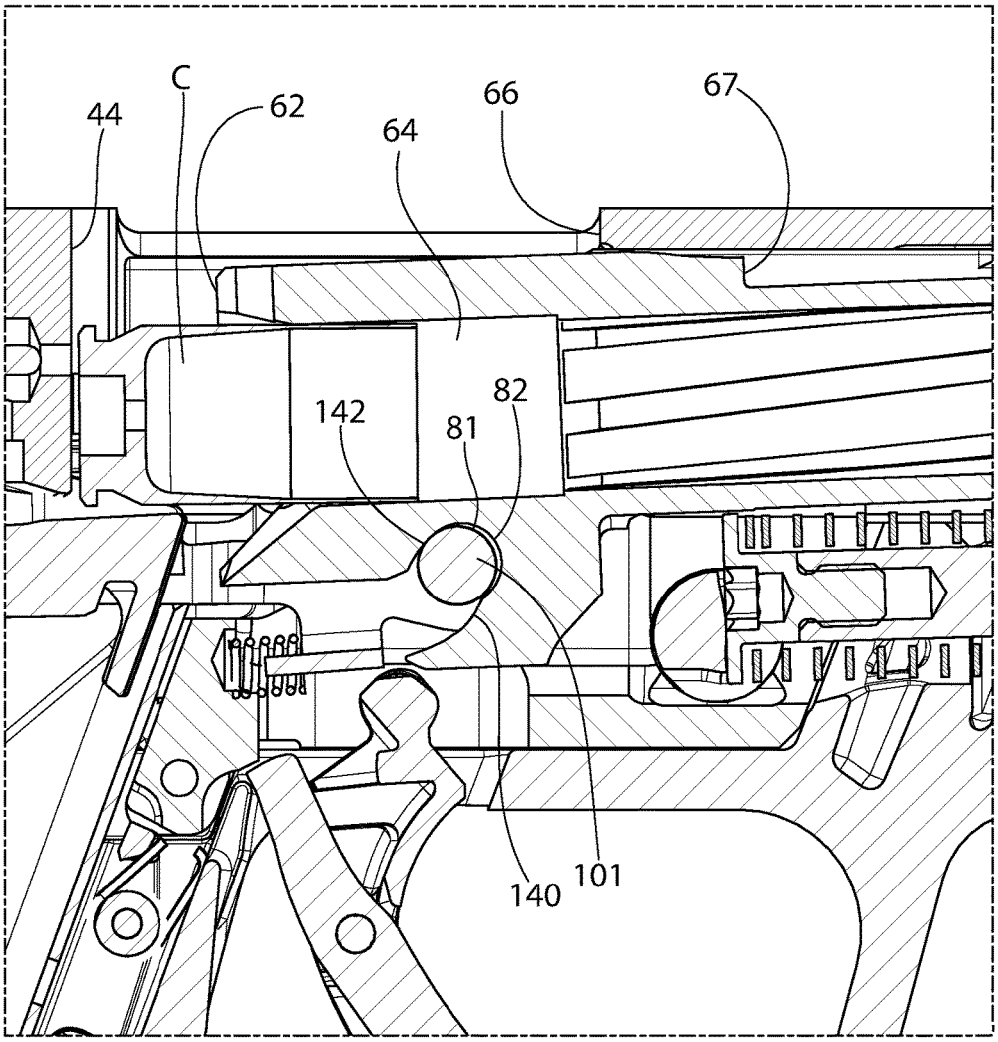
FIG. 14 is an enlarged detail from FIG. 13 showing the cam pin in a fourth position in the cam slot.
Figure 15:
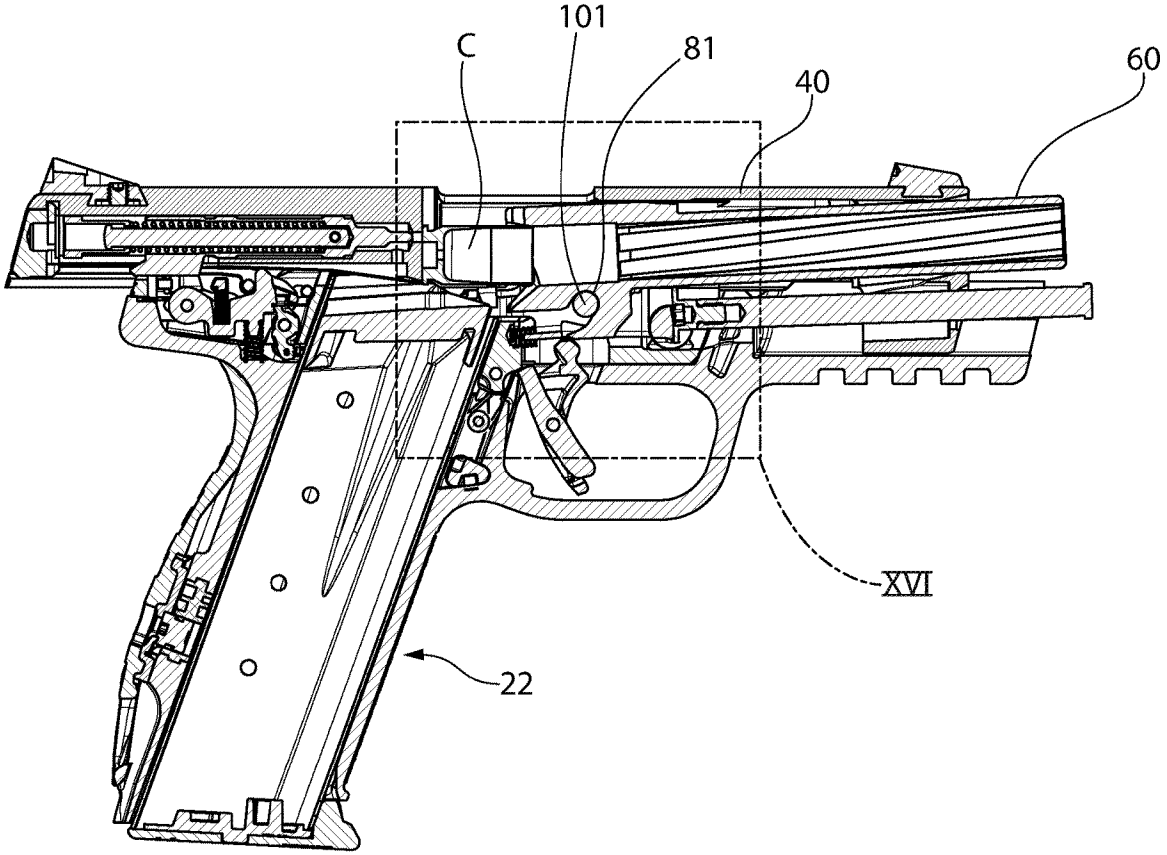
FIG. 15 is a right side cross sectional view of the pistol with the action shown in a fifth recoil position in which the barrel motion is fully arrested.
Figure 16:
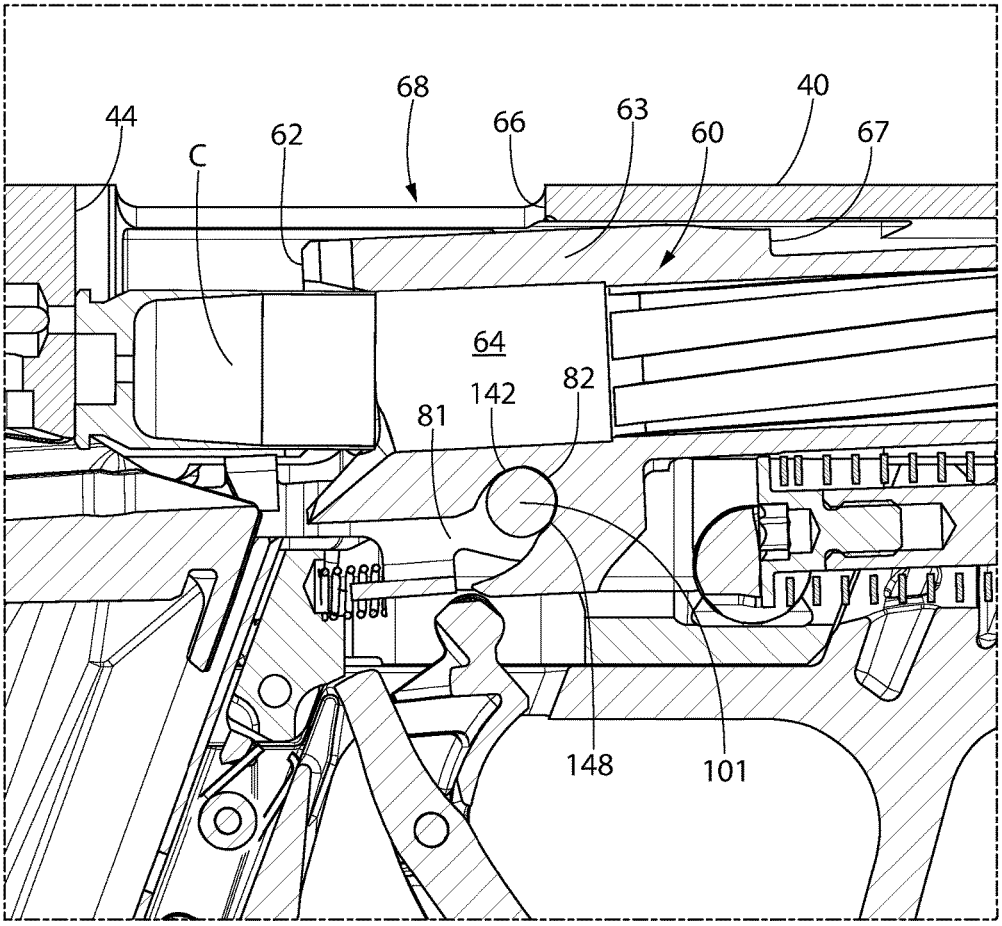
FIG. 16 is an enlarged detail from FIG. 15 showing the cam pin in a fifth position seated in the end of the cam slot.
Figure 17:
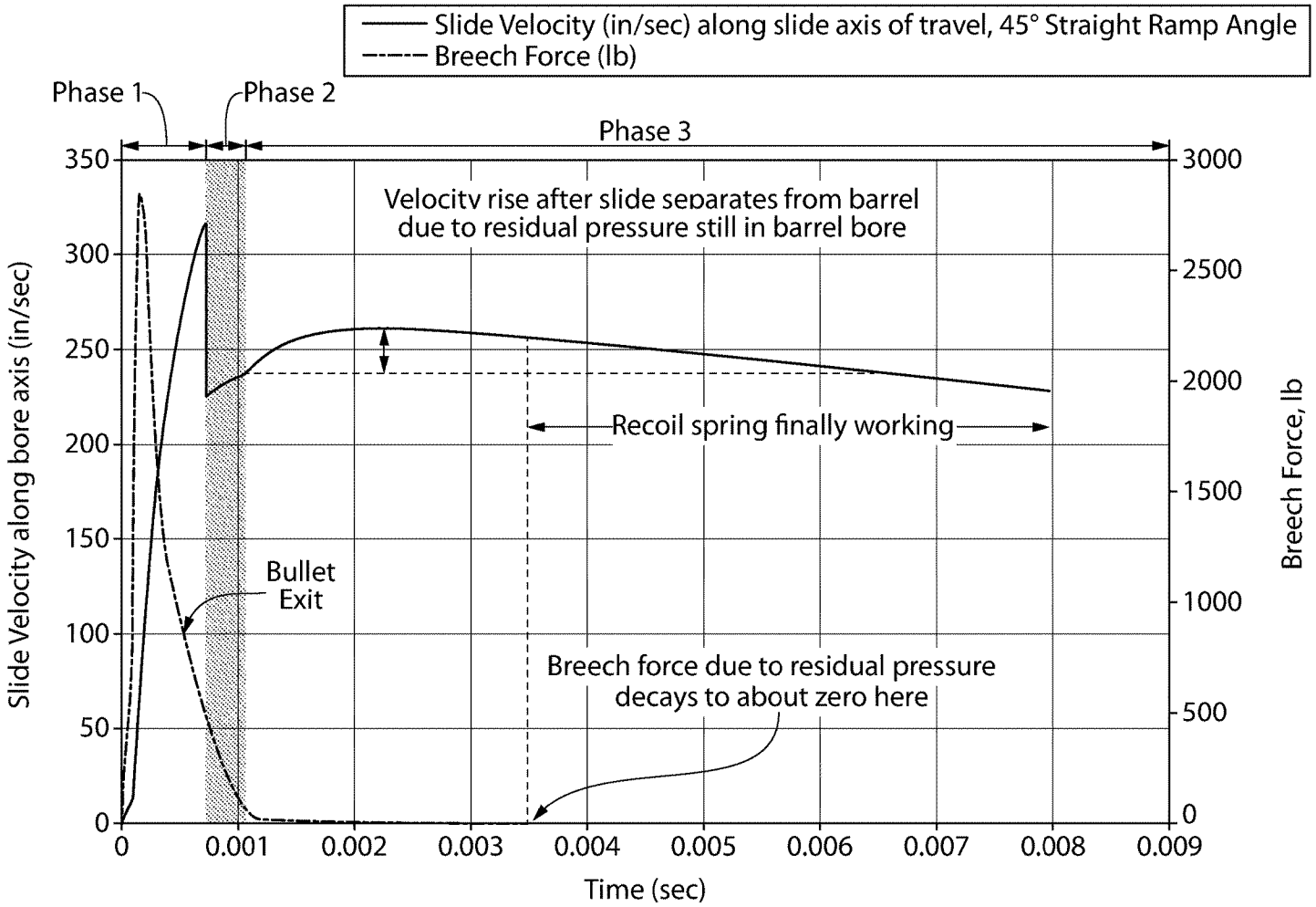
FIG. 17 is a graph showing different phases of the recoil portion of the pistol operation comparing time with slide velocity and breech force.

Referring to FIGS. 13 and 14, with the slide 40 traveling rearward alone and the breech area 45 open as shown, the cam pin 101 slides to the end of the final cam section 140 of the cam track surface 84 and traverses upward onto the inflection and re-direction surfaces 142, 141 by the momentum of the barrel 60. Momentum causes the barrel to travel parallel to surface 140 until it primarily contacts re-direction surface 141. The cam pin 101 slides forward along the re-direction surface 141 and around the front of the slot traveling downwards now in a second change of direction into the lower undercut surface 148. The pin 101 may roll around in the undercut surface 148 until the barrel motion is finally completely arrested and the cam pin 101 becomes seated in the front end 82 of the cam slot 81 as shown in FIGS. 15 and 16. The barrel 60 is rotated or tilted to its maximum extent.

Figure 19:
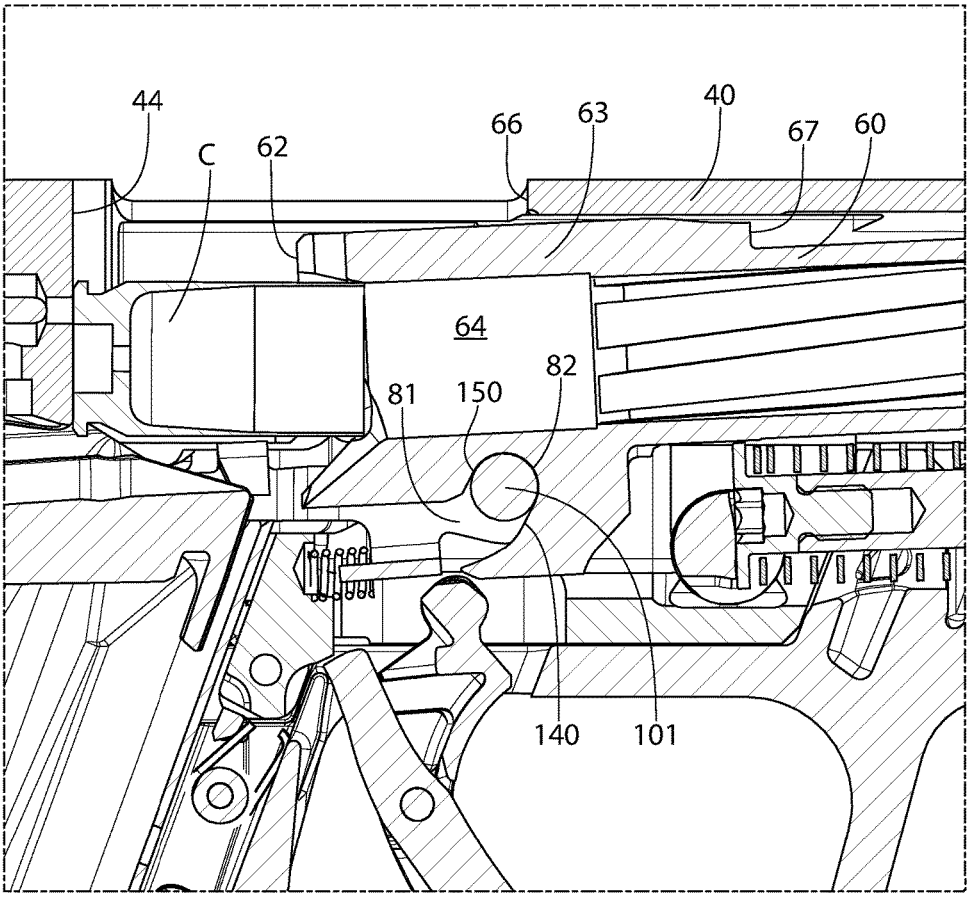
FIG. 19 is an enlarged detail from FIG. 18 showing the cam pin in a position seated in the end of the cam slot.

It bears noting that the same general process described above for the S-shape curve cam slot applies to the second embodiment of a cam slot configuration shown in FIGS. 18-21, with exception of the foregoing description related to FIGS. 14-15 since this latter embodiment lacks an upper re-direction surface 141 and lower undercut surface 148. Accordingly, the cam pin 101 slides forward along the linear final cam section 140 of the cam track surface 84 as shown in FIGS. 11 and 12 until it reaches the end of this section and encounters the closed front end 82 of the cam slot 81 where it becomes seated as shown in FIGS. 18 and 19 of this second embodiment. In the second embodiment, it should be noted that the cam pin 101 remains fully slideably engaged at all times with the lower cam track surface 84 and the upper track 141 of the slot play no major active role in controlling the motion or orientation of the barrel 60 under recoil.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm with variable barrel camming system, the firearm comprising:

a longitudinal axis;

a frame;

a slide movably supported on the frame for rearward and forward reciprocating movement;

a barrel removably coupled to the slide and movable therewith, the barrel comprising a front muzzle end, a rear breech end defining a chamber for holding an ammunition cartridge, and axial bore extending between the ends;

a camming lug protruding downward from the barrel and including a cam slot defining an upper surface and an opposing lower cam track surface, the cam slot including a rear end and an opposing front end;

a cam pin fixedly mounted transversely in the frame, the cam pin arranged to slideably engage the lower cam track surface when the barrel is carried rearward with the slide under recoil after firing the pistol;

the lower cam track surface comprising an initial cam section disposed adjacent the rear end of the cam slot, a concave intermediate variable cam section adjoining and forward of the initial cam section, and a final cam section adjoining and forward of the intermediate variable cam section, the initial and final cam sections each having a different cam profile than the intermediate variable cam section;

wherein the cam pin slideably engages and tracks along the lower cam track surface after firing the pistol causing the barrel in turn to rotate and uncouple from the slide.

2. The firearm according to claim 1, wherein the initial and final cam sections each have a linear cam profile defining a flat surface oriented obliquely to the longitudinal axis of the pistol.

3. The firearm according to claim 2, wherein the cam pin slidingly moves from rear to front along the cam track surface in a straight path along the initial cam section, in an arcuate path along the intermediate variable cam section, and in a straight path along the final cam section.

4. The firearm according to claim 2, wherein the initial cam section of the cam track surface is disposed at an angle between and including 15 to 20 degrees to a horizontal reference plane, and the final cam section is disposed at an angle of more than 30 degrees and less than 60 degrees to the horizontal reference plane.

5. The firearm according to claim 1, wherein the intermediate variable cam section has a smooth arcuately curved surface with a varying radius of curvature.

6. The firearm according to claim 1, further comprising a concave undercut surface formed on the cam track surface between the final cam section and the front end of the cam slot.

7. The firearm according to claim 6, further comprising a convexly shaped lower prominence formed on the cam track surface between the final cam section and the undercut surface.

8. The firearm according to claim 7, wherein the upper surface of the cam slot comprises an undercut concave re-direction surface located opposite the final cam section of the lower cam track surface, the re-direction surface arranged and operable to engage the cam pin after the cam pin engages the final cam section under recoil.

9. The firearm according to claim 8, further comprising a convexly curved inflection surface formed on the upper surface of the cam slot adjoining and rearwardly of the re-direction surface.

10. The firearm according to claim 1, wherein the final cam section has a linearly straight cam profile and extends from the intermediate variable cam section to the closed front end of the cam slot.

11. The firearm according to claim 1, wherein the cam track surface operates to change the angular orientation of the barrel such that the front muzzle end of the barrel rotates upwards and the rear breech end of the barrel rotates downwards when the cam pin slides along the cam track surface to uncouple the barrel from the slide.

12. The firearm according to claim 1, wherein the barrel and slide each include a locking surface that are mutually engaged to couple the barrel to the slide, and wherein rotating the barrel disengages the locking surfaces to uncouple the barrel from the slide.

13. The firearm according to claim 1, wherein the rear end of the cam slot is open and the front end is closed defining an arcuately curved end surface.

14. A barrel with cam slot for a firearm, the barrel comprising:

a tubular body defining a longitudinal axis;

a muzzle end and a breech end defining a chamber for holding an ammunition cartridge;

an axial bore extending between the breech and muzzle ends defining a projectile pathway;

a camming lug protruding downward from the breech end of the barrel; and a multi-contoured cam slot formed in the camming lug and configured to slideably engage a cam pin, the cam slot including a rear end, a front end, a rear upper surface extending between rear and front ends, and a front lower cam track surface extending between the rear and front ends opposite the upper surface;

the lower cam track surface having an undulating cam profile comprising a first concave surface, a second concave surface located forward of the first concave surface, and a convex protrusion arranged between the first and second concave cam surfaces.

15. The barrel according to claim 14, further comprising a first flat initial cam surface adjoining and located rearward of the first concave cam surface, and having a linear cam profile.

16. The barrel according to claim 14, wherein the upper surface of the cam slot includes an arcuately curved concave re-direction surface adjoining the front end of the cam slot and opposite the convex protrusion.

17. A method for operating a firearm, the method comprising:

providing a firearm including a longitudinal axis, a frame, a horizontally oriented slide supported by the frame in a sliding manner for rearward and forward reciprocating motion, a horizontally oriented barrel removably coupled to the slide and including a cam slot including an upper surface and an opposing lower cam track surface, and a cam pin fixedly disposed transversely in the frame;

discharging the firearm;

moving the slide and barrel rearward together in coupled relationship;

moving the cam pin forward in the cam slot;

slideably engaging the cam pin with an initial cam section of the lower cam track surface of the cam slot;

slideably engaging the cam pin with an intermediate variable cam section of the lower cam track surface of the cam slot having an arcuately curved concave cam profile;

rotating the barrel about the cam pin and uncoupling the barrel from the slide via engagement with the variable cam section;

slideably engaging the cam pin with a final cam section of the lower cam track surface of the cam slot;

disengaging the cam pin from the final cam section;

slideably engaging the cam pin with a re-direction surface of the upper surface of the cam slot having an arcuately curved concave cam profile, the re-direction surface being disposed on an opposite side of the cam slot from the final cam section; and engaging a closed front end of the cam slot with the cam pin, wherein motion of the barrel is arrested.

18. The barrel according to claim 14, wherein the first concave cam surface has an arcuately curved surface with a varying radius of curvature.

19. The barrel according to claim 14, further comprising a second flat cam surface located between the second concave cam surface and the convex protrusion, and having a linear cam profile.

20. The barrel according to claim 14, wherein the rear end of the cam slot is rearwardly open.

21. A method for operating a firearm, the method comprising:

providing a firearm including a longitudinal axis, a frame, a horizontally oriented slide supported by the frame in a sliding manner for rearward and forward reciprocating motion, a horizontally oriented barrel removably coupled to the slide and including a cam slot, and a cam pin fixedly disposed transversely in the frame;

discharging the firearm;

moving the slide and barrel rearward together in coupled relationship;

moving the cam pin forward in the cam slot;

slideably engaging the cam pin with an initial cam section of the cam slot;

slideably engaging the cam pin with an intermediate variable cam section of the cam slot having an arcuately curved concave cam profile;

rotating the barrel about the cam pin and uncoupling the barrel from the slide via engagement with the variable cam section;

slideably engaging the cam pin with a final cam section of the cam slot;

disengaging the cam pin from the final cam section;

slideably engaging the cam pin with a re-direction surface of the cam slot having an arcuately curved concave cam profile, the re-direction surface being disposed on an opposite side of the cam slot from the final cam section; and engaging a closed front end of the cam slot with the cam pin, wherein motion of the barrel is arrested.

22. The method according to claim 21, further comprising slideably engaging the cam pin with an undercut surface of the cam slot having an arcuately curved concave cam profile after engaging the re-direction surface, the undercut surface being disposed on an opposite side of the cam slot from the re-direction surface adjacent the front end of cam slot.

23. The method according to claim 22, further comprising rolling the cam pin around the undercut surface and re-direction surfaces until the motion of the barrel is arrested and the cam pin settles in the closed front end of the cam slot.

24. The method according to claim 21, wherein the initial and final cam sections each have a linear cam profile defining a flat surface.

* * * * *